US009347137B2

(12) United States Patent
Teramoto et al.

(10) Patent No.: US 9,347,137 B2
(45) Date of Patent: May 24, 2016

(54) METHOD OF MANUFACTURING ELECTRODE FOR ELECTRICAL-DISCHARGE SURFACE TREATMENT, AND ELECTRODE FOR ELECTRICAL-DISCHARGE SURFACE TREATMENT

(75) Inventors: Hiroyuki Teramoto, Tokyo (JP); Yukio Sato, Tokyo (JP); Akihiro Suzuki, Tokyo (JP); Akihiro Goto, Tokyo (JP); Kazushi Nakamura, Tokyo (JP)

(73) Assignees: IHI CORPORATION, Tokyo (JP); Mitsubishi Electric Corporation, Tokyo (JP)

( * ) Notice: Subject to any disclaimer, the term of this patent is extended or adjusted under 35 U.S.C. 154(b) by 2531 days.

(21) Appl. No.: 11/916,044

(22) PCT Filed: Sep. 11, 2006

(86) PCT No.: PCT/JP2006/317999
§ 371 (c)(1),
(2), (4) Date: Feb. 21, 2008

(87) PCT Pub. No.: WO2008/032359
PCT Pub. Date: Mar. 20, 2008

(65) Prior Publication Data

US 2009/0127110 A1 May 21, 2009

(51) Int. Cl.
*C23C 14/00* (2006.01)
*B22F 1/00* (2006.01)
(Continued)

(52) U.S. Cl.
CPC ..... *C23C 26/00* (2013.01); *B22F 1/0062* (2013.01); *B22F 1/0085* (2013.01); *C22C 1/1084* (2013.01); *C22C 19/07* (2013.01); *C23C 8/12* (2013.01); *B22F 2998/10* (2013.01)

(58) Field of Classification Search
CPC .... B22F 1/0062; B22F 1/0085; B22F 1/0003; B22F 1/0096; B22F 2998/10; C22C 1/1084; C22C 19/07; C22C 26/00; C23C 8/12
USPC ..... 219/69.15, 69.17; 428/457; 427/540, 427/580
See application file for complete search history.

(56) References Cited

U.S. PATENT DOCUMENTS 2,796,505 A 6/1957 Bocciarelli
3,496,512 A 2/1970 Yoshio et al.
(Continued)

FOREIGN PATENT DOCUMENTS

EP 1 544 321 A1 6/2005
EP 1 643 007 A1 4/2006
(Continued)

OTHER PUBLICATIONS

Chinese Office Action (mailed Feb. 5, 2010).
(Continued)

*Primary Examiner* — Eric Stapleton
(74) *Attorney, Agent, or Firm* — Sughrue Mion, PLLC; Richard C. Turner

(57) ABSTRACT

A method of manufacturing an electrode for electrical-discharge surface treatment includes increasing oxygen content in the powder; mixing the powder, in which the oxygen content is increased, with an organic binder and a solvent to prepare a liquid mixture; granulating the powder in the liquid mixture to form granulated powder; and forming the granulated powder to prepare a compact in which an oxygen concentration ranges from 4 weight % to 16 weight %.

13 Claims, 18 Drawing Sheets

(51) Int. Cl.

| | |
|---|---|
| ***B27N 3/02*** | (2006.01) |
| ***C23C 26/00*** | (2006.01) |
| ***C22C 1/10*** | (2006.01) |
| ***C22C 19/07*** | (2006.01) |
| ***C23C 8/12*** | (2006.01) |

(56) References Cited

U.S. PATENT DOCUMENTS

| | | | | |
|---|---|---|---|---|
| 3,503,787 | A | | 3/1970 | Pendse |
| 3,745,296 | A | | 7/1973 | Shinopulos |
| 3,872,419 | A | | 3/1975 | Groves et al. |
| 4,451,815 | A | | 5/1984 | Sakshaug et al. |
| 4,452,728 | A | | 6/1984 | Carlson et al. |
| 4,736,183 | A | | 4/1988 | Yamazaki et al. |
| 4,835,508 | A | | 5/1989 | Seike et al. |
| 4,959,632 | A | | 9/1990 | Uchida |
| 5,509,558 | A | | 4/1996 | Imai et al. |
| 5,651,901 | A | | 7/1997 | Mohri et al. |
| 5,818,005 | A | * | 10/1998 | Pratt et al. ..... 219/69.15 |
| 5,874,885 | A | | 2/1999 | Chandler et al. |
| 6,163,245 | A | | 12/2000 | Andoh et al. |
| 6,232,209 | B1 | | 5/2001 | Fujiwara et al. |
| 6,929,829 | B2 | * | 8/2005 | Mohri et al. ..... 427/540 |
| 7,095,310 | B2 | | 8/2006 | Imai et al. |
| 2005/0211165 | A1 | | 9/2005 | Goto et al. |
| 2006/0021868 | A1 | | 2/2006 | Goto et al. |
| 2006/0035068 | A1 | | 2/2006 | Ochiai et al. |

FOREIGN PATENT DOCUMENTS

| | | | |
|---|---|---|---|
| JP | 04-346632 | | 12/1992 |
| JP | 06-060716 | | 3/1994 |
| JP | 07-070761 | A | 3/1995 |
| JP | 07-112329 | A | 5/1995 |
| JP | 2001-184924 | B2 | 7/2001 |
| JP | 2005213560 | A | 8/2005 |
| JP | 2006-124741 | A | 5/2006 |
| JP | 2006124741 | A | 5/2006 |
| KR | 2005-0055625 | A | 6/2005 |
| RU | 2005-124741 | A | 6/2006 |
| TW | 469195 | | 12/2001 |
| TW | 500815 | | 9/2002 |
| TW | 240757 | | 10/2005 |
| TW | 250908 | | 3/2006 |
| WO | 2004011696 | A1 | 2/2004 |
| WO | 2004029329 | A1 | 4/2004 |
| WO | 2004/108989 | A1 | 12/2004 |
| WO | 2005068670 | A1 | 7/2005 |

OTHER PUBLICATIONS

Extended European Search Report dated Mar. 15, 2010 in corresponding EP Application No. 06 78 3272.

Communication dated Sep. 23, 2014, issued by the Indian Patent Office in counterpart Indian application No. 1912/CHENP/2009.

Communication dated Jan. 27, 2015, issued by the U.S. Patent and Trademark Office in U.S. Appl. No. 13/281,884.

Communication (Non-final Office Action), dated Jun. 11, 2014, issued by the U.S. Patent and Trademark Office in co-pending U.S. Appl. No. 13/281,884, pp. 1-18.

* cited by examiner

METHOD OF MANUFACTURING ELECTRODE FOR ELECTRICAL-DISCHARGE SURFACE TREATMENT, AND ELECTRODE FOR ELECTRICAL-DISCHARGE SURFACE TREATMENT

TECHNICAL FIELD

The present invention generally relates to an electrode for electrical-discharge surface treatment and a technology for manufacturing the same. The present invention specifically relates to an electrode for electrical-discharge surface treatment and a technology for manufacturing the same used to form an oxidized metal film on a material to be treated in electrical-discharge surface treatment performed by using a compact as an electrode formed with metal powder or with powder of a metal alloy or using a compact obtained by heating the compact, by generating pulsed discharge between the electrode and the material to be treated in a liquid such as oil or in the air, and melting an electrode material by the energy of the pulsed discharge to form a film on the material to be treated.

BACKGROUND ART

Conventionally, a method of forming a film on the surface of metal, the film being made of other metal materials or ceramics, is widely used to provide wear resistance to the surface of the metal. Such a metal on which a film has been formed is usually used in a temperature environment from room temperature to about 200° C., and in most of the cases, oil lubricant is also applied on the surface. However, an oil lubricant cannot be used when such a metal is used to make components, such as aero-engine components, that are used in environments with a wide temperature range from room temperature to about 1000° C. Therefore, it becomes necessary to exhibit wear resistance properties by using the strength or lubricant capability of the material itself.

Wear-resistant material that can be used for components that are used in high temperature environment, such as aero-engine components or the like, include metal material such as Tribaloy and Stellite with cobalt (Co) and molybdenum (Mo) as a main component. Conventionally, methods of forming a film made of these metal materials on a material to be treated using cladding by welding or using plasma spraying are used. However, these methods of forming the film have a problem such that the material to be treated is thermally deformed or a film with satisfactory adhesion strength is not obtained.

Technologies have been disclosed for forming a film that does not cause thermal deformation of the material to be treated or reduction in the strength thereof but that has sufficient wear resistance even under high temperature. For example, technologies have been disclosed for forming a film based on an electrode material by generating pulsed discharge between a powder compact and a material to be treated (e.g., see Patent document 1 or Patent document 2). Each of Patent document 1 and Patent document 2 disclose a method of mixing an oxide into an electrode as a method of solving the problem on wear resistance in an intermediate temperature range, which is the problem on the conventional film.

Furthermore, technologies have been disclosed for providing an electrode used for electrical-discharge surface treatment, which is obtained by pulverizing powder without being oxidized in a manufacturing process, for an electrical-discharge surface treatment electrode (e.g., Patent Document 3). Patent document 3 discloses a method of forming a green compact electrode by using powder obtained by pulverizing metal powder in a solution, mixing wax as a binder in a mixture containing the pulverized metal powder and the solution, and drying and granulating the mixture in an inert gas atmosphere.

Patent document 1: International Publication No. 2004/029329 Pamphlet

Patent document 2: International Publication No. 2005/068670 Pamphlet

Patent document 3: Japanese Patent Application Laid-Open No. 2005-213560

Patent document 4: International Publication No. 2004/011696 Pamphlet

DISCLOSURE OF INVENTION

Problem to be Solved by the Invention

However, the inventors of this invention have found from their study that conventionally used wear-resistant materials sufficiently exhibit wear resistance in a low temperature range (about 300° C. or less) and a high temperature range (about 700° C. or higher) but do not exhibit wear resistance satisfactorily in an intermediate temperature range (from about 300° C. to about 700° C.).

FIG. 18 is a characteristic diagram representing a relationship between temperature and wear loss of test pieces in a sliding test. For the sliding test, as shown in FIG. 19, test pieces (upper test piece 813*a* and lower test piece 813*b*) were prepared by welding cobalt (Co) alloy metal, which is a conventionally used wear-resistant material, onto respective test-piece bodies 812 using Tungsten Inert Gas (TIG) welding. Then, the sliding test was conducted by arranging the upper test piece 813*a* and the lower test piece 813*b* so that their films 811 face each other, and reciprocally sliding the test pieces in the X direction shown in FIG. 19 by $1\times10^6$ cycles at a frequency of 40 Hz with a width of 0.5 mm while applying a load so that the surface pressure is 3 MPa to 7 MPa. The cobalt (Co) alloy metal is welded onto the test-piece bodies 812 and then ground to smooth the surfaces of the cobalt (Co) alloy metals 811.

In the characteristic diagram of FIG. 18, the horizontal axis represents the temperature of the atmosphere in which the sliding test was conducted. Specifically, the test was performed at a temperature in a range from room temperature to about 900° C. The vertical axis of the characteristic diagram represents the total value of wear losses of the upper and lower test pieces 813*a* and 813*b* after the sliding test was conducted (after sliding of $1\times10^6$ cycles). No lubricant was applied no the test pieces, i.e., the sliding test was conducted without a lubricant.

It is clear from the characteristic diagram of FIG. 18 that the wear loss of the cobalt (Co) alloy metal, which was conventionally used as the wear-resistant material, is large in the intermediate temperature range. The material used in this test is a cobalt (Co) base alloy material containing Cr (chromium), Mo (molybdenum), and Si (silicon).

Although the above test results were obtained by using the materials prepared by welding, it is found from the tests conducted by the inventors that the wear loss in the intermediate temperature range is also large in the films formed based on the technology for using pulsed discharge, which is disclosed in Patent document 1 and Patent document 4.

The reason of these phenomena can be considered as follows although it is disclosed in Patent document 1. More specifically, in the high temperature range, chromium (Cr) or molybdenum (Mo) in the material is exposed to high temperature environment and it is thereby oxidized thereby generating chromium oxide or molybdenum oxide having lubricity. The lubricity of chromium oxide or Molybdenum oxide reduces the wear loss. In the low temperature range, the temperature of the material is low, which helps the material keep its strength, and the strength also helps the wear loss be low. In the intermediate temperature range, however, there is no lubricity resulting from the oxides, moreover, the strength of the material becomes low because of its temperature being partly high, and this causes the wear resistance to decrease, which leads to an increase in the wear loss.

On the other hand, to improve the wear resistance in the intermediate temperature range, Patent document 2 discloses a method of mixing an oxide into the electrode. With this method, the wear resistance in the intermediate temperature range is improved but the strength of the film is reduced due to mixing the oxide into the electrode, which causes the wear resistance to decrease in the low temperature range.

As for the method of manufacturing the electrode for electrical-discharge surface treatment, Patent document 3 discloses a method of pulverizing the metal without oxidized it and then granulating it when manufacture the electrode. Even in the case of the film formed by this method, however, the wear resistance in the intermediate temperature range is not satisfactory for the same reason as above.

Furthermore, to stably exhibit the functions of the films having the wear resistance, it is necessary to form a uniform film. A film is formed unless the electrical-discharge surface treatment is performed by using an electrode without a crack or variations in density and resistance. However, in the method disclosed in Patent document 3, cracks may be produced in the electrode or there may remain variations in the density and the resistance of the electrode.

The present invention has been made in view of the above. It is an object of the present invention to obtain an electrode for electrical-discharge surface treatment and a method of manufacturing the electrode capable of forming a film excellent in wear resistance in a temperature range from low temperature to high temperature through the electrical-discharge surface treatment.

Means for Solving Problem

To solve the above problems and to achieve the above object, a method of manufacturing an electrode for electrical-discharge surface treatment used for electrical-discharge surface treatment for using a formed compact obtained by forming metal powder, metal compound powder, or conductive ceramics powder as an electrode, generating pulsed discharge between the electrode and a work in a working fluid or in the air, and forming a film on a surface of the work by energy of the pulsed discharge, the film being made of a material of the electrode or made of a substance with which the material of the electrode reacts, includes an oxygen-amount adjusting step of increasing oxygen content in the powder; a mixing step of mixing the powder, in which the oxygen content is increased, with an organic binder and a solvent to prepare a liquid mixture; a granulating step of granulating the powder in the liquid mixture to form granulated powder; and a forming step of forming the granulated powder to prepare a compact in which an oxygen concentration ranges from 4 weight % to 16 weight %.

Effect of the Invention

According to the present invention, it is possible to manufacture the electrode for electrical-discharge surface treatment capable of forming the film excellent in wear resistance in the temperature range from low temperature to high temperature without a crack and variations in density and resistance in the electrode. By forming the film through the electrical-discharge surface treatment using the electrode for electrical-discharge surface treatment manufactured according to the present invention, it is possible to form the film excellent in the wear resistance over the temperature range from low temperature to high temperature while maintaining the strength of the film.

BRIEF DESCRIPTION OF DRAWINGS

FIG. 3-1 is a characteristic diagram representing a relationship between electrical resistance and wear loss of test pieces when a sliding test was conducted using films formed by a plurality of electrodes whose surfaces have different electrical resistances.

FIG. 3-2 is a schematic of test pieces obtained by welding the films according to the first embodiment onto respective test-piece bodies using TIG welding.

FIG. 6-1 is a diagram representing one example of pulse conditions for electrical discharge during electrical-discharge surface treatment, and representing a voltage waveform between the electrode and a work upon electrical discharge.

FIG. 6-2 is a diagram representing another example of the pulse conditions for electrical discharge during electrical-discharge surface treatment, and representing a current waveform of a current flowing upon electrical discharge.

FIG. 8-1 is a schematic representing test pieces obtained by welding the films according to the first embodiment onto respective test-piece bodies using TIG welding.

FIG. 8-2 is a graph for comparison of a relationship between the temperature and the wear loss of the film according to the first embodiment with an example in which test pieces were made by welding.

FIG. 10-1 is a characteristic diagram representing a relationship between electrical resistance and wear loss of test pieces when a sliding test was conducted using films formed by a plurality of electrodes whose surfaces have different electrical resistances.

FIG. 10-2 is a schematic of test pieces obtained by welding the films according to the fourth embodiment onto respective test-piece bodies using TIG welding.

FIG. 13-1 is a diagram representing one example of pulse conditions for electrical discharge during electrical-discharge surface treatment, and representing a voltage waveform between the electrode and a work upon electrical discharge.

FIG. 13-2 is a diagram representing another example of the pulse conditions for electrical discharge during electrical-discharge surface treatment, and representing a current waveform of a current flowing upon electrical discharge.

EXPLANATIONS OF LETTERS OR NUMERALS

Figure 1:
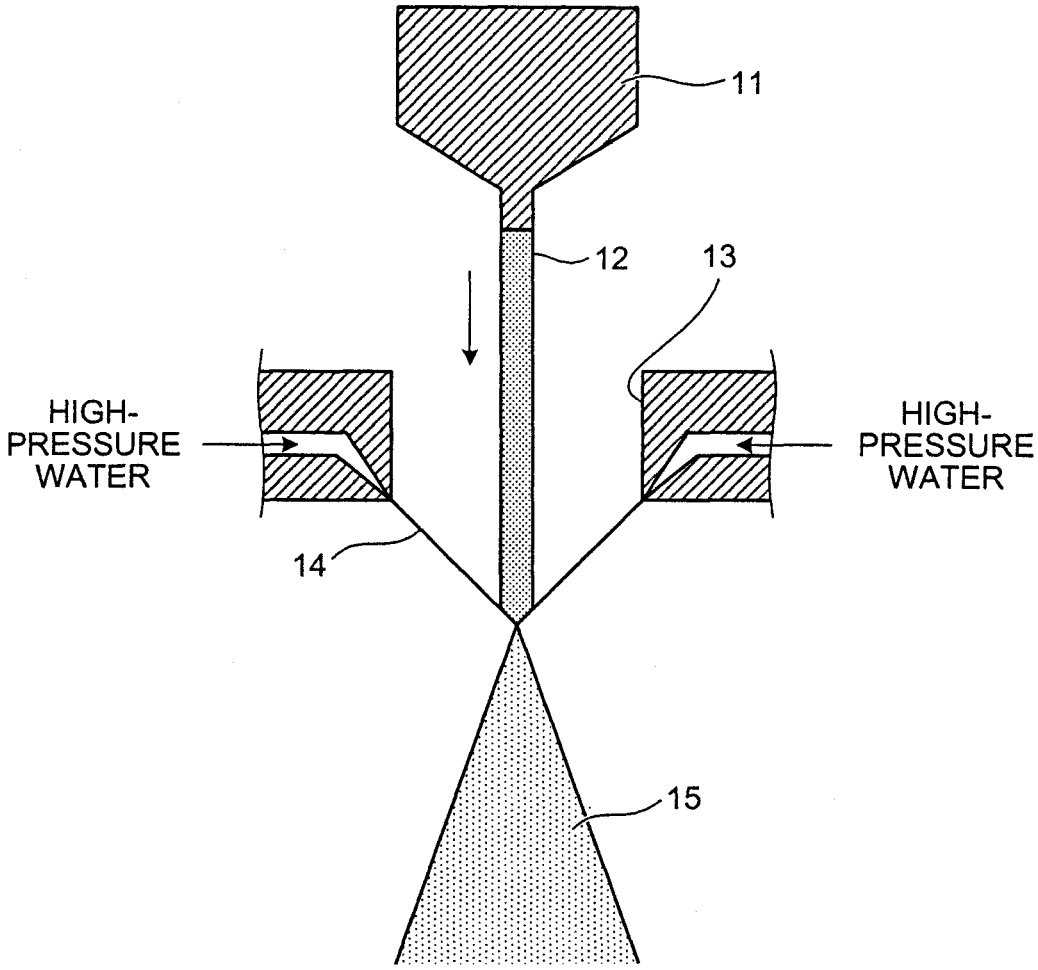
FIG. 1 is a schematic for explaining a method of manufacturing scrap metal powder using a water atomization method.

11 Tundish
12 Molten metal
13 Nozzle
14 High-pressure water
15 Powder
101 Buffer tank
102 Grinding chamber
103 Feeder
104 Raw powder material
105 Coarse-grained powder
106 Cyclone
107 Finely pulverized powder
108 Bug filter
201 Granulated powder
202 Upper punch
203 Lower punch
204 Die
251 Film
252 Test-piece body
253*a* Upper test piece
253*b* Lower test piece
301 Electrode
302 Work
303 Working fluid
304 Power supply for electrical-discharge surface treatment
305 Arc column
501 Film
502 Test-piece body
503*a* Upper test piece
503*b* Lower test piece
811 Cobalt (Co) alloy metal
812 Test-piece body
813*a* Upper test piece
813*b* Lower test piece
1201 Granulated powder
1202 Upper punch
1203 Lower punch
1204 Die
1251 Film
1252 Test-piece body
1253*a* Upper test piece
1253*b* Lower test piece
1301 Electrode
1302 Work
1303 Working fluid
1304 Power supply for electrical-discharge surface treatment
1305 Arc column

BEST MODE(S) FOR CARRYING OUT THE INVENTION

The outline of the present invention is explained first. The inventors of the present invention have found, from the result of their study, that a solution in which oxidized metal powder, an organic binder, and a solvent are mixed and dried to obtain granulated powder and the granulated powder is used to manufacture an electrode for electrical-discharge surface treatment, which enables manufacture of the electrode without variations in density and resistance. Moreover, with such an electrode it is possible to form a film excellent in wear resistance over a range from low temperature to high temperature.

In the conventional inventions, importance is given to prevention of a metal from being oxidized; however, in the method of manufacturing the electrode for electrical-discharge surface treatment according to the present invention, importance is given to obtaining metal powder oxidized in a range of oxygen concentration from 4 weight % to 16 weight %. As a method of obtaining such powder, for example, at first, oxide powders of metals are mixed by a predetermined amount. The mixed powder is then heated for 10 minutes to 10 hours at a temperature of 100° C. to 500° C. in an oxidizing atmosphere such as an air furnace. Then the powder is pulverized by using a jet mill in the oxidizing atmosphere so as to control an average particle size thereof to be 0.5 μm to 1.7 μm.

To obtain an electrode without cracks or variations in density and resistance, it is necessary to granulate the pulverized and oxidized metal powder, form the granulated powder, and then sinter the formed powder to manufacture the electrode. This can be achieved by appropriately selecting oxidized metal powder, an organic binder, and a solvent, blending selected ones in an adequate mixing ratio, and granulating the powder with an average particle size of 10 μm to 100 μm by using a granulator such as a spray dryer. The oxidized metal powder used here includes metal powder containing an oxide of at least one or more elements selected from silicon (Si), chromium (Cr), iron (Fe), cobalt (Co), nickel (Ni), zirconium (Zr), molybdenum (Mo), barium (Ba), rhenium (Re), and tungsten (W).

As an organic binder of the granulated powder, at least one of paraffin, isobutyl methacrylate, stearic acid, and polyvinyl alcohol (PVA) is used. As a solvent, at least one or more of water, ethanol, butanol, propanol, heptane, isobutane, acetone, and normal-hexane is selected to be used. At this time, it is preferable that the organic binder be 1 weight % to 20 weight % of the weight of oxidized metal powder. It is also preferable that a solution, in which a volume ratio of the total of a solute volume of the oxidized metal powder and the organic binder to the solvent be 2 volume % to 30 volume %, is used to be granulated.

An electrode is manufactured at steps of press-forming the obtained granulated powder under a press pressure of 50 MPa to 200 MPa, holding a compact for 30 minutes to 2 hours in a temperature range from 150° C. to 400° C., and then, sintering the compact for 1 hour to 4 hours at a temperature of 600° C. to 1000° C. With these steps, the crack of the electrode can be prevented and the variations in density and resistance are also prevented to manufacture an electrode for electrical-discharge surface treatment. By performing the electrical-discharge surface treatment using the thus-manufactured electrode for electrical-discharge surface treatment, it is possible to form a film excellent in wear resistance in a temperature range from low temperature to high temperature.

The electrode for electrical-discharge surface treatment according to the present invention is characterized in that an electrical resistance on the surface of the electrode itself, which is measured using a four-terminal method, ranges from $5\times10^{-3}\Omega$ to $10\times10^{-3}\Omega$, and that an oxygen concentration in the electrode ranges from 4.5 weight % to 10 weight %. By performing the electrical-discharge surface treatment using the thus-configured electrode for electrical-discharge surface treatment according to the present invention, it is possible to form the film excellent in wear resistance in the temperature range from low temperature to high temperature.

Exemplary embodiments of the electrode for electrical-discharge surface treatment and the method of manufacturing the electrode for electrical-discharge surface treatment according to the present invention are explained in detail below with reference to the attached drawings. It is noted that the present invention is not limited by the following description, and, therefore, any modification is possible without departing the scope of the present invention. The attached drawings may have different graphic scales in components for easy understanding.

First Embodiment

A first embodiment of the present invention is explained below using materials of "28 weight % Mo (molybdenum), 17 weight % Cr (chromium), 3 weight % Si (silicon), and the rest Co (cobalt)" as an example. In the present invention, however, the same effect can be obtained even by using any material other than the materials, for example, materials explained in other embodiments.

FIG. 1 is a schematic for explaining a method of manufacturing scrap metal powder using a water atomization method. The water atomization method is a method of manufacturing metal powder by spraying molten metal with high-pressure water and solidifying the molten metal. At first, metal, which is blended in the proportion of 28 weight % Mo (molybdenum), 17 weight % Cr (chromium), 3 weight % Si (silicon), and the rest Co (cobalt), is molten and fed into a container called a tundish. Molten metal 12 falling from a tundish 11 is poured into a portion of a spraying hole called nozzle 13 by each predetermined amount. At this time, high-pressure water 14 is jetted to cause the molten metal 12 to be atomized and finely dispersed, and is collected while being solidified as powder 15 in a container (not shown) provided in the lower side.

In the water atomization method, the powder of particles generally with an average particle size of tens of μm to hundreds of μm is prepared. On the other hand, because the present invention requires fine powder, the powder with an average particle size of several μm is prepared by increasing the water pressure.

However, satisfactorily fine powder cannot be obtained only by using the water atomization method. Therefore, the powder prepared by the water atomization method is classified to obtain powder with an average particle size of 3 μm or less. In the present embodiment, the powder with an average particle size of 3 μm or less is explained, but powder with an average particle size of about 1 μm or less is more preferable. However, if the powder with an average particle size of about 1 μm or less is prepared by being classified, a collection rate is extremely reduced and a manufacturing cost thereby increases. Therefore, at the present, the powder with an average particle size of about 3 μm is appropriate in terms of industrial manufacture of the powder. It is noted that the water atomization method is explained in the present embodiment, but there is no technological problem even if any other method such as gas atomization is used.

A method of oxidizing the powder prepared in the above method is explained below. The powder with an average particle size of 3 μm obtained by the water atomization method is placed in an oxidizing atmosphere.

In the following example, an oven having an air atmosphere was used. The powder was put in a carbon-made container, and the container was input into the oven having an air atmosphere where it was heated for 24 hours at a temperature of 500° C. The heater of the oven was turned off, the air atmosphere in the oven was naturally cooled to room temperature, and the powder was taken out therefrom. The amount of oxygen contained in the powder was 8 weight % as a result of measuring it. The amount of oxygen contained in the powder varies depending on a heating temperature, a heating time, a powder material, and a particle size of powder. The powder is more easily oxidized as the heating temperature is raised, the heating time is increased, and as the particle size of powder is reduced. As a result, the amount of oxygen contained in the powder increases.

It is understood, from determination on the results of experiments, that a range from 4 weight % to 16 weight %, preferably 6 weight % to 14 weight % is appropriate as the amount of oxygen contained in the powder. If the amount of oxygen contained in the powder exceeds the range, the strength of the formed film becomes low. If the amount of oxygen contained in the powder exceeds 16 weight % in particular, it becomes extremely difficult to homogeneously form the powder at a forming step explained later. Moreover, if the amount of oxygen contained in the powder is less than 4 weight %, the wear resistance of the formed film deteriorates, which makes it difficult to reduce the wear in the intermediate temperature range, as is explained in the conventional technology.

The forming step of an electrode is explained below. To form a homogeneous compact by improving flowability of powder when a mold is filled with the powder for press forming using the mold, making faster propagation of the press pressure to the inside of the powder, and reducing friction between the wall of the mold and the powder, petroleum wax (paraffin) as the organic binder was added to pulverized powder at a weight ratio of 10% thereto. The weight ratio of the amount of the organic binder to the pulverized powder needs to be set to a range from 1 weight % to 20 weight %.

If an organic-binder content is 1 weight % or less, the organic binder does not function as a binder, and hence, the pressure upon being pressed does not evenly spread and the strength of the compact is low, which makes it difficult to handle the compact. On the other hand, if the organic-binder content exceeds 20 weight %, the powder is adhered to the mold when being pressed, and the compact may crack because the powder is not removed from the mold. Therefore, the amount of organic binder needs to be set to the range from 1 weight % to 20 weight % with respect to the pulverized powder. If the amount falls within the range, it is possible to adjust the porosity of a targeted compact by controlling the mixing ratio between the powder and the organic binder.

As a solvent to uniformly mix the paraffin with the pulverized powder, normal-hexane was used. The normal-hexane was mixed with paraffin of 10 weight % of powder weight to dissolve the paraffin, and then, pulverized cobalt (Co) alloy powder was added thereto and further mixed.

At this time, the amount of normal-hexane was controlled so that the weight (weight of the solute) of the pulverized cobalt (Co) alloy powder and the organic binder would become 10 volume % of the normal-hexane which is the solvent. If a solute concentration with respect to the solvent is low, drying becomes difficult, and thus, the granulated powder cannot be prepared. On the other hand, if the solute concentration is too high, the powder precipitates, and thus, the concentration of the solution becomes inhomogeneous. This makes it difficult to obtain homogeneous granulated powder. Therefore, it is necessary to control so that a solute component with respect to the solvent becomes 2 volume % to 30 volume %. By setting the total volume of the pulverized cobalt (Co) alloy powder and the organic binder to the range, homogeneous granulated powder can be obtained.

In the present embodiment, the wax was mixed in the solvent at the beginning and then the powder was fed into the mixed solvent, but the pulverized cobalt (Co) alloy powder may be fed into the solvent from the beginning and mixed.

The example of using the paraffin as the organic binder is explained above, but the organic binder may be isobutyl methacrylate, stearic acid, or polyvinyl alcohol other than the paraffin.

Furthermore, even if heptane or isobutane is used other than the normal-hexane as the solvent when the paraffin is used, it can be also dissolved. If any other solvent is used, the paraffin cannot sufficiently be dissolved. Therefore, by dispersing the paraffin in the state of powder, the granulated powder can also be obtained. The other solvents include water, ethanol, butanol, propanol, and acetone.

Next, as a granulating step, a dry granulator generally called a spray dryer was used to spray the mixed solution to an atmosphere in which high-temperature nitrogen was circulated, and the solvent was dried. At the time of drying, a solvent component (normal-hexane in the present embodiment) vaporizes from the mixed solution, and the mixed solution becomes spherical granulated powder in which the oxidized metal powder and the organic binder are uniformly dispersed. The granulated powder has high flowability because of a small angle of repose, which enables to obtain a compact in which void spaces are uniformly formed upon its forming, and which has no variation in the density and the resistance.

To obtain an electrode having uniform density and resistance which is the object of the present invention, the average particle size of the granulated powder is preferably 10 μm to 100 μm. If the average particle size thereof is 10 μm or less, the flowability of the powder becomes low, and it is difficult to evenly fill the mold with the powder. On the other hand, if the particle size thereof is 100 μm or more, the void spaces remaining when the powder is press-formed are easily enlarged, and a homogeneous electrode cannot thereby be obtained.

The example of using the spray dryer for granulation is explained in the present embodiment, but it is possible to obtain the granulated powder using any other method such as a fluidized granulator and a tumbling granulator.

Figure 2:
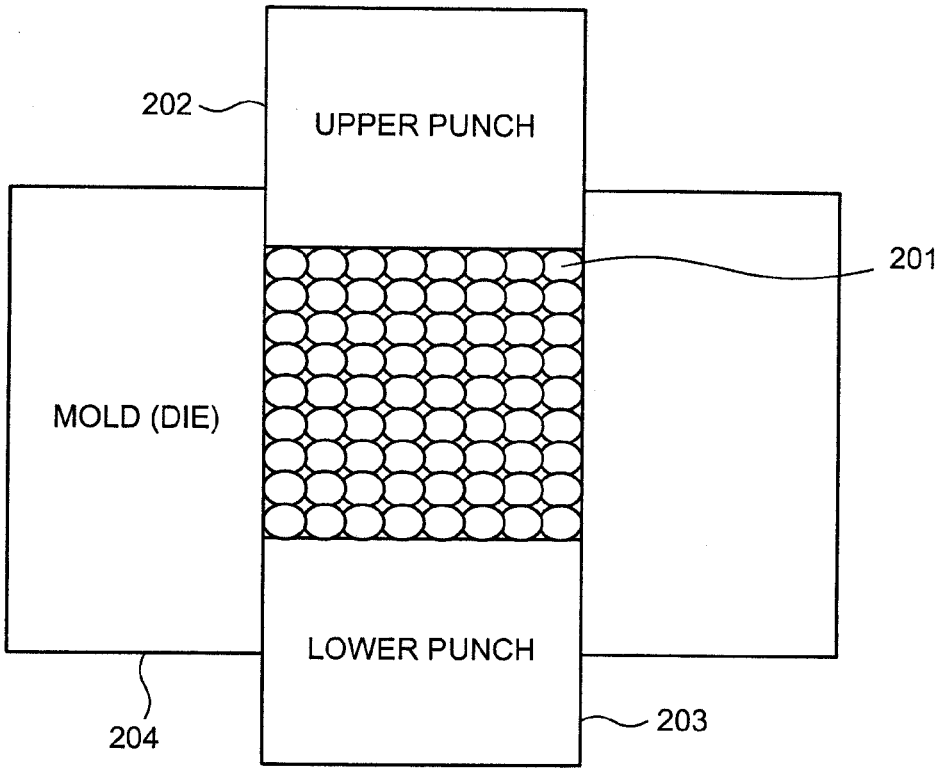
FIG. 2 is a cross-section for explaining a concept of a powder formation step according to a first embodiment of the present invention.

The forming step of granulated powder is explained below with reference to FIG. 2. FIG. 2 is a cross-section representing a concept of the forming step of granulated powder according to the present embodiment. In FIG. 2, the space surrounded with an upper punch 202 of a mold, a lower punch 203 of the mold, and a die 204 of the mold is filled with granulated powder 201 prepared at the previous step. And, the granulated powder 201 is compressed and formed to form a green compact (compact). In an electrical-discharge surface treatment explained later, the green compact (compact) is used as a discharge electrode.

Press pressure and sintering temperature for forming granulated powder are set to a range from 50 MPa to 200 MPa and a range of a heating temperature from 600° C. to 1000° C. although they are different depending on the resistance and the oxygen concentration of a targeted electrode. In the present embodiment, granulated powder was formed under a pressure of 100 MPa, to obtain a compact with a length of 100 mm, a width of 11 mm, and a thickness of 5 mm. It is noted that vibration was applied to the mold before forming so that the mold was uniformly filled with the powder, and the powder was pressurized and formed. If the forming pressure is lower than 50 MPa, the void spaces remain between the granulated powders, and a homogeneous electrode cannot thereby be formed. If the forming pressure exceeds 200 MPa, some problems arise such that cracking occurs in the electrode and the electrode cannot be removed from the mold. Therefore, the forming pressure is preferably 50 MPa to 200 MPa.

The obtained green compact (compact) is subjected to sintering. As a step of removing an organic binder from the electrode upon heating, the green compact is held for about 30 minutes to 2 hours at a temperature from 150° C. to 400° C. to enable stably and sufficiently remove the organic binder from a sintered compact. Generally, the organic binder has a property of expansion due to heating, and thus, if the organic binder is rapidly heated, any defect in quality such as expansion of or cracking in the electrode may easily occur. Therefore, the heating should not be increased to a sintering temperature at one time, and the compact needs to be temporarily held until the organic binder is completely removed therefrom.

In the present embodiment, the green compact (compact) was held in a vacuum furnace for 30 minutes at a temperature of 200° C., and then heated up to 300° C. for 1 hour. The green compact was further heated up to 700° C. for 1 hour, held for about 1 hour, and cooled to room temperature to manufacture a cobalt (Co) alloy electrode made of the cobalt (Co) alloy powder.

The resistance of the electrode on its surface with a length of 100 mm and a width of 11 mm being a pressed face of the cobalt (Co) alloy electrode was measured by a surface resistivity meter using the four-terminal method in which an inter-electrode distance is 2 mm. As a result of measurement, the resistance of the electrode was $7.5\times10^{-3}\Omega$.

The electrode is broken by pulsed discharge energy and is molten to be formed as a film, as shown in the latter part, and thus, it is important whether or not the electrode is easily broken due to electrical discharge. In such an electrode, a range from $5\times10^{-3}\Omega$ to $10\times10^{-3}\Omega$ is an appropriate value of the resistance on the surface of the electrode measured using the four-terminal method, and a range from $6\times10^{-3}\Omega$ to $9\times10^{-3}\Omega$ is more preferable.

Figures 1, 3:
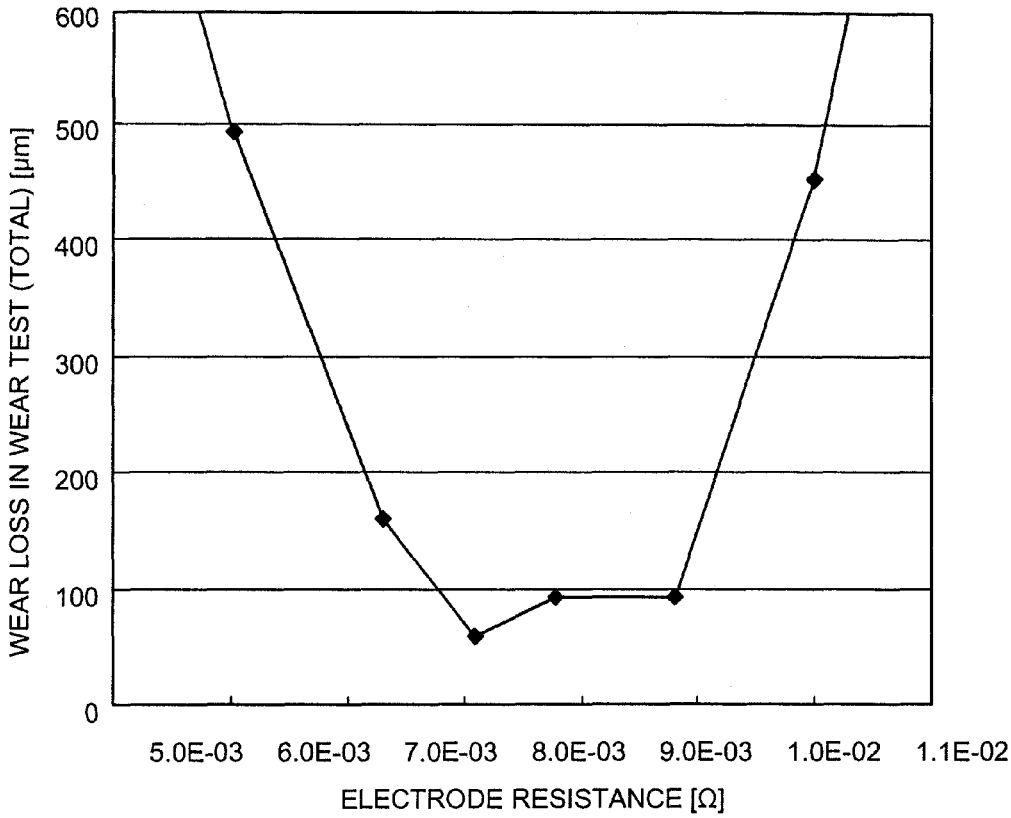
Figures 2, 3:
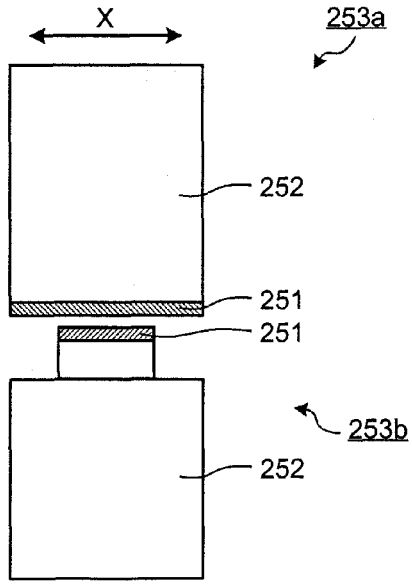

A plurality of electrodes with different resistances on the surfaces of the electrodes thus manufactured were used to form films using an electrical-discharge surface treatment method explained later, and a sliding test was conducted on the films. The result of the test is shown in FIG. 3-1. In FIG. 3-1, the horizontal axis represents the resistance in ohm (Ω) of the electrode surface. The vertical axis represents the wear loss of the electrode. As a test piece, test pieces (upper test piece 253*a* and lower test piece 253*b*) were made by welding films 251 onto respective test-piece bodies 252 using TIG welding as shown in FIG. 3-2.

The upper test piece 253*a* and the lower test piece 253*b* were arranged so that the films 251 face each other. And a test was conducted by sliding the test pieces in a reciprocating manner in the X direction of FIG. 3-2 by $1\times10^6$ cycles at a frequency of 40 Hz with a width of 0.5 mm while a load was applied so that their surface pressure becomes 7 MPa. It is noted that the film was welded onto the test-piece body 252 and then the film was ground to smooth the surface of the film 251.

As is clear from FIG. 3-1, when an electrode with a range of the resistance on the electrode surface from $5\times10^{-3}\Omega$ to $10\times10^{-3}\Omega$ is used, the wear loss is low, and when an electrode with the range from $6\times10^{-3}\Omega$ to $9\times10^{-3}\Omega$ is used, the wear loss is particularly low. Therefore, as the electrode used in the present embodiment, the range from $5\times10^{-3}\Omega$ to $10\times10^{-3}\Omega$ is an appropriate value as the resistance on the electrode surface using the four-terminal method, and the range from $6\times10^{-3}\Omega$ to $9\times10^{-3}\Omega$ is more preferable.

Figure 7:
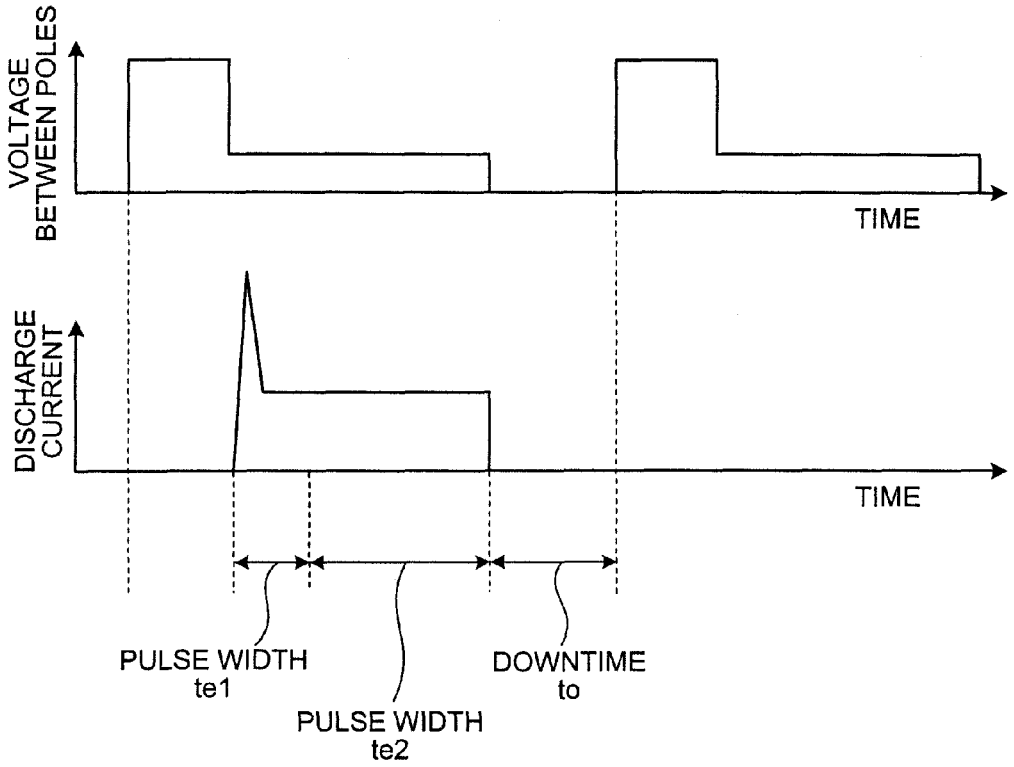
FIG. 7 is a diagram representing another example of the pulse conditions for electrical discharge during electrical-discharge surface treatment.

The electrical conditions for the electrical-discharge surface treatment used for the sliding test are such that a waveform is applied with a current with a narrow width and a high peak during a period of discharge pulses, as shown in FIG. 7 explained later, a current value at the portion of the high peak is about 15 A, a current value at the portion of a low peak is about 4 A, and discharging duration (discharge pulse width) is about 10 μs.

Figure 4:
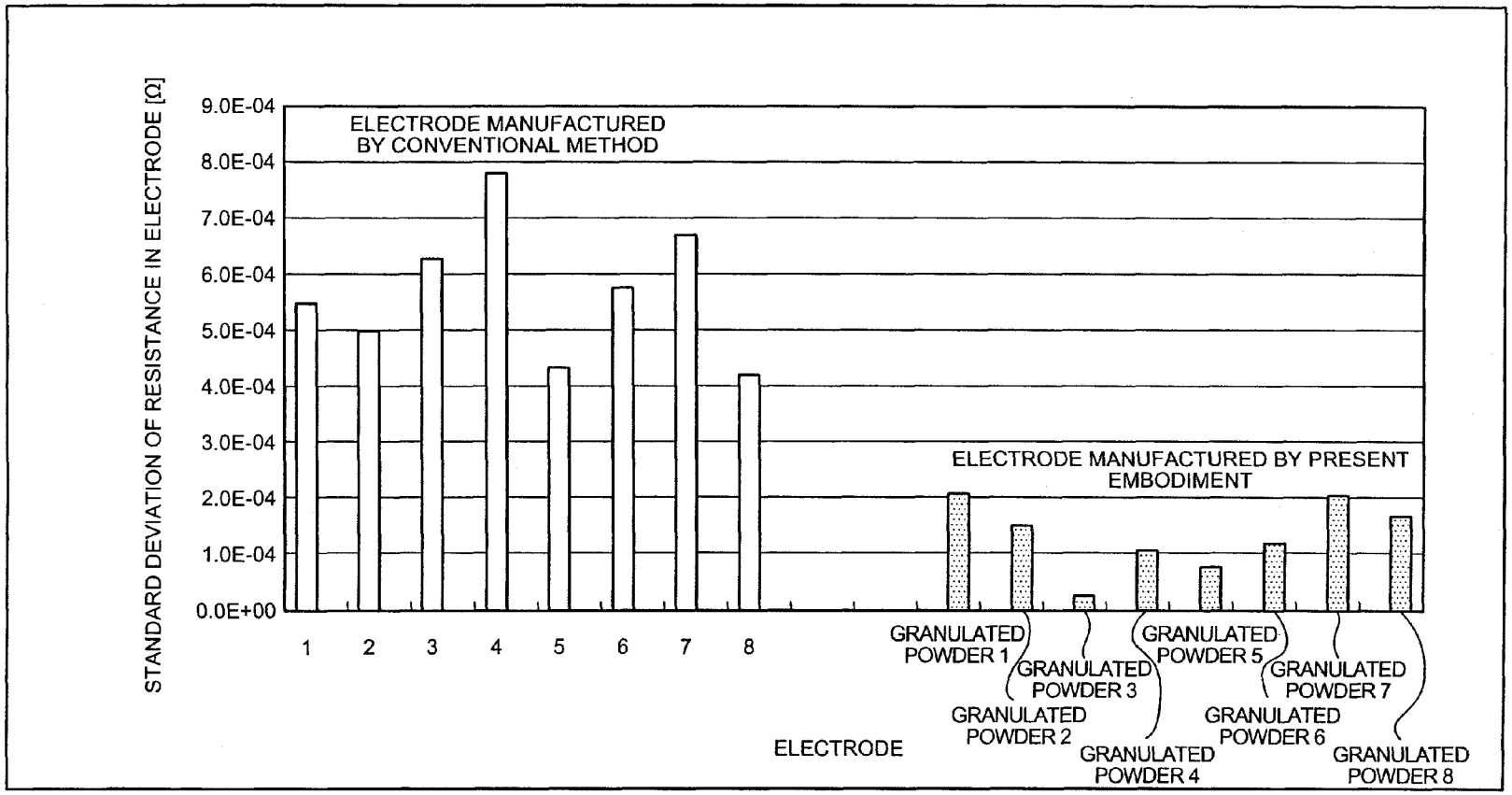
FIG. 4 is a chart representing standard deviation of resistance on an electrode surface of the electrode according to the first embodiment of the present invention.

FIG. 4 represents standard deviation of resistances measured on the electrode at three points such as both ends and a center thereof in its longitudinal direction using the four-terminal method. In FIG. 4, the horizontal axis represents electrodes, and the vertical axis represents the standard deviation of the resistances measured at the three points. The resistances of electrodes press-formed and manufactured in the conventional method are also shown in FIG. 4 for reference. The electrodes are manufactured in the following manner: shape of electrode: 100 mm length×11 mm width×5 mm thickness, press pressure: 100 MPa, and sintering in vacuum: 700° C.×1 hour. It is obvious from the chart that there are sufficiently small variations in the resistance at each position in the longitudinal direction of the electrodes using the powder according to the present invention.

The amount of oxygen of the electrode manufactured in the present embodiment was measured by an infrared absorption method, and as a result, the oxygen concentration was 8 weight %. The oxygen concentration of the electrode is not always equal to that of the powder used. To exhibit excellent wear resistance over a wide range of temperature, the amount of oxygen of the film becomes eventually important, but when the amount of oxygen of the film ranges from 5 weight % to 9 weight %, the film most excellent in the wear resistance can be obtained.

The resistance and the oxygen concentration of the electrode are determined by an oxygen concentration of the powder to be used, and by the amount of binder, a press pressure, and a sintering temperature upon manufacture of the electrode. Therefore, it is important to manufacture the electrode by adequately controlling these requirements so that the resistance and the amount of oxygen of the electrode fall within the appropriate ranges.

Figure 5:
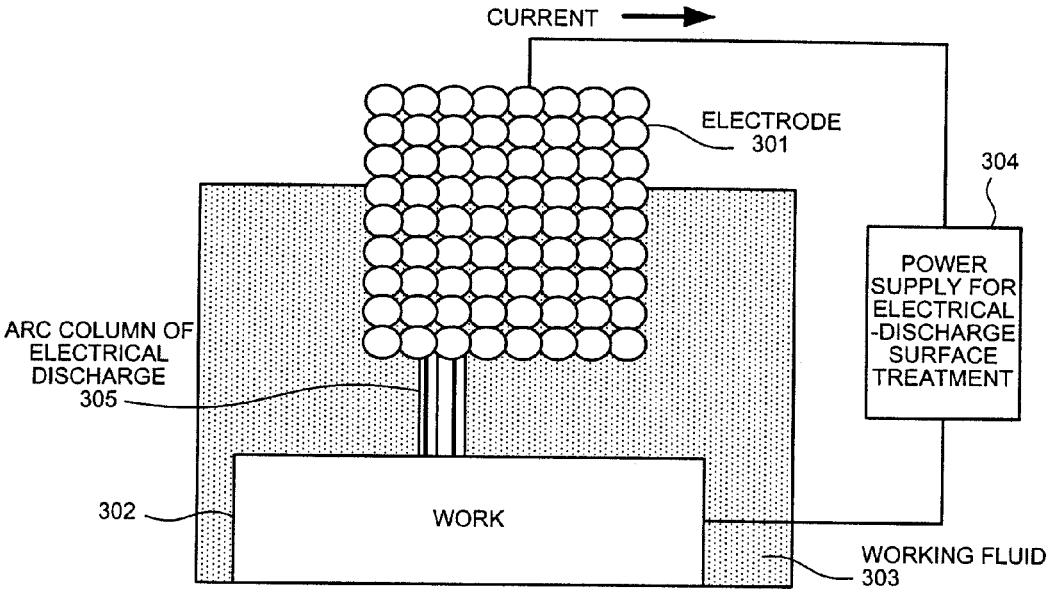
FIG. 5 is a schematic diagram of a configuration of an electrical-discharge surface treatment device that performs electrical-discharge surface treatment according to the first embodiment of the present invention.

Next, a film is formed on a material to be treated (work) by the electrical-discharge surface treatment method using the electrode manufactured in the above manner. FIG. 5 represents a schematic diagram of a configuration of an electrical-discharge surface treatment device that performs electrical-discharge surface treatment in the present embodiment. As shown in FIG. 5, the electrical-discharge surface treatment device according to the present embodiment includes an electrode 301 made of the granulated powder of the cobalt (Co) alloy powder, oil as a working fluid 303, a working-fluid supply unit (not shown) that immerses the electrode 301 and a work 302 in the working fluid or supplies the working fluid 303 between the electrode 301 and the work 302, and a power supply 304 for electrical-discharge surface treatment that applies a voltage between the electrode 301 and the work 302 to generate pulsed discharge (arc column 305). In FIG. 5, some components not directly related to the present invention such as a drive unit that controls a relative position between the power supply 304 for electrical-discharge surface treatment and the work 302 are omitted.

To form a film on the work surface by the electrical-discharge surface treatment device, the electrode 301 and the work 302 are arranged so as to face each other in the working fluid 303, and pulsed discharge is generated in the working fluid 303 from the power supply 304 for electrical-discharge surface treatment between the electrode 301 and the work 302. The film of the electrode material is formed on the work surface by discharge energy of the pulsed discharge, or the film of a substance with which the electrode material reacts is formed on the work surface by the discharge energy. A negative polarity is used for the electrode 301 and a positive polarity is used for the work 302. As shown in FIG. 5, the arc column 305 of the electrical discharge is generated between the electrode 301 and the work 302.

Figures 1, 6:
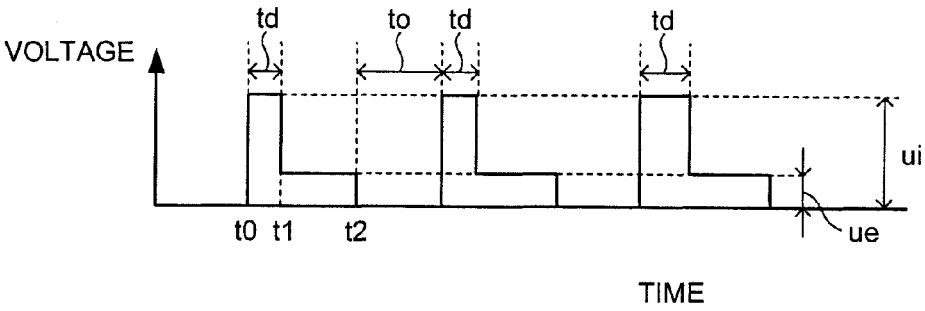
Figures 2, 6:
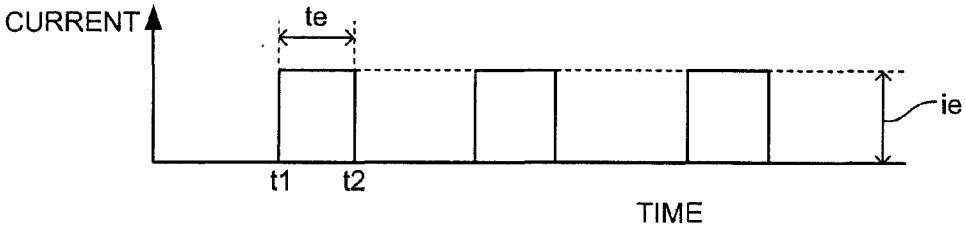

The electrical-discharge surface treatment was performed by using a green compact electrode manufactured under the conditions, to form a film. One example of pulse conditions for electrical discharge during electrical-discharge surface treatment are shown in FIG. 6-1 and FIG. 6-2. FIG. 6-1 and FIG. 6-2 are diagrams representing one example of pulse conditions for electrical discharge during electrical-discharge surface treatment. FIG. 6-1 represents a voltage waveform between an electrode and a work upon electrical discharge, and FIG. 6-2 represents a current waveform of a current flowing during electrical discharge. In FIG. 6-1, the voltage of the electrode with the negative polarity is described on the horizontal axis (positive).

As shown in FIG. 6-1, a non-load voltage ui is applied between both poles at time t0, but a current starts flowing between the both poles at time t1 after passage of discharge delay time td, and electrical discharge starts. The voltage at this time is a discharge voltage ue and the current flowing at this time is a peak current value ie. If supply of the voltage between the both poles is stopped at time t2, the current does not flow.

Time t2 to t1 is a pulse width te. The voltage waveform during time t0 to t2 is repeatedly applied to the both poles after downtime "to". In other words, as shown in FIG. 6-1, a pulsing voltage is applied between the electrode for electrical-discharge surface treatment and the work.

In the present embodiment, when the current waveform is a rectangular waveform as shown in FIG. 6-2, appropriate electrical conditions for the discharge pulse during electrical-discharge surface treatment are such that a peak current value ie=2 A to 10 A and discharging duration (discharge pulse width) te=5 μs to 20 μs. However, these ranges may slightly shift depending on how the electrode is easily broken. Moreover, to break the electrode more satisfactorily by pulses of electrical discharge, it has become understood that a waveform applied with a current whose width is narrow and peak is high during a period of discharge pulse is effective as shown in FIG. 7. In FIG. 7, the voltage of the electrode with the negative polarity is described on the horizontal axis (positive).

By using such a current waveform, the electrode can be broken by the current having a waveform with a high peak as shown in FIG. 7, and melting can be progressed by the current having a waveform with a low peak and a wide width as shown in FIG. 7, which enables the film to be formed on the work 302 at a high speed. In this case, an appropriate current value at the portion of the waveform with a high peak was about 10 A to 30 A, an appropriate current value of a current at the portion of the waveform with a low peak and a wide width was about 2 A to 6 A, and an appropriate discharging duration (discharge pulse width) was about 4 μs to 20 μs. If the current at the portion of the waveform with the low peak and the wide width is lower than 2 A, it becomes difficult to continue the discharge pulse, and this leads to an increase in phenomenon of pulse crack which means the current is disconnected in midstream.

Figures 1, 8:
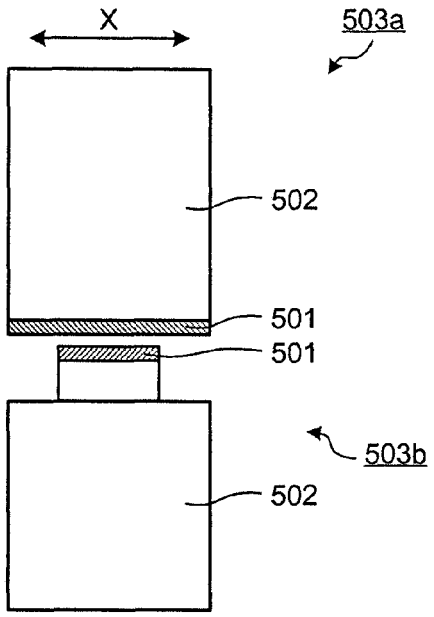
Figures 2, 8:
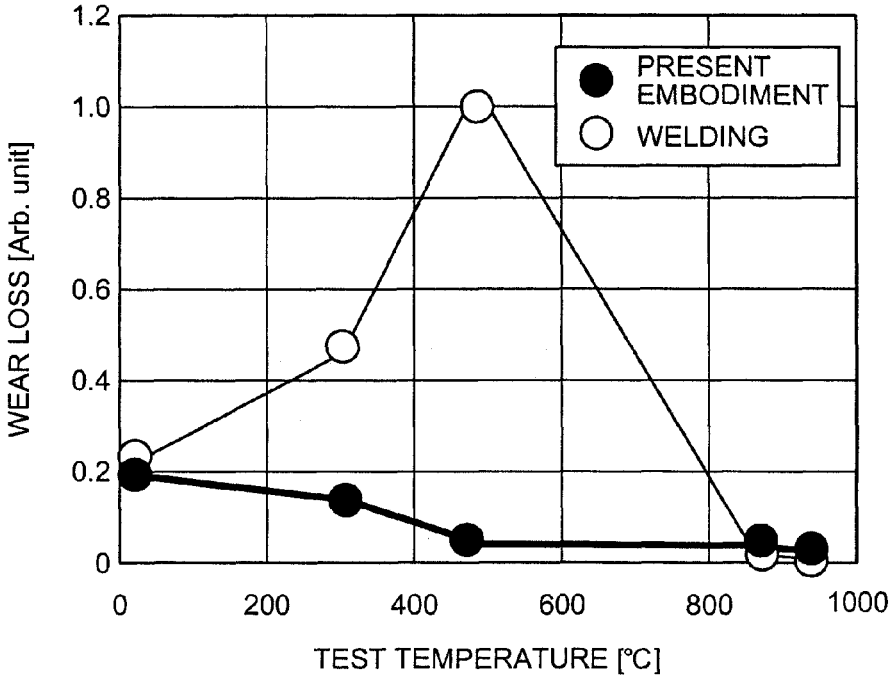

The test piece as shown in FIG. 8-1 was made from the film formed through the electrical-discharge surface treatment using the electrode for electrical-discharge surface treatment according to the present embodiment, and the sliding test was conducted. In the sliding test, at first, films 501 were formed through the electrical-discharge surface treatment using the electrode for electrical-discharge surface treatment according to the present embodiment as shown in FIG. 8-1. And test pieces (upper test piece 503*a* and lower test piece 503*b*) were made by welding the films 501 onto respective test-piece bodies 502 through TIG welding. The upper test piece 503*a* and the lower test piece 503*b* were arranged so that the films 501 face each other. And a test was conducted by sliding the test pieces in a reciprocating manner in the X direction of FIG. 8-1 by $1\times10^6$ cycles at a frequency of 40 Hz with a width of 0.5 mm while a load was applied so that their surface pressure becomes 3 MPa to 7 MPa. It is noted that the film was formed on the test-piece body 252 and then the film was ground to smooth the surface of the film 501.

The result of the sliding test conducted in the above manner is shown in FIG. 8-2. FIG. 8-2 is a characteristic diagram representing a relationship between the temperature and the wear loss of the test piece. In the characteristic diagram of FIG. 8-2, the horizontal axis represents the temperature of an atmosphere in which the sliding test was conducted, and referring to the present test, the sliding test was conducted at temperatures in a range from room temperature to about 900° C. In the characteristic diagram of FIG. 8-2, the vertical axis represents the total value of wear losses of the upper and lower test pieces 503*a* and 503*b* after the sliding test (after sliding of $1\times10^6$ cycles). It is noted that oil lubricant was not supplied, and thus the sliding test was conducted without being lubricated.

As a comparative example, the result of a sliding test is also shown in FIG. 8-2. The sliding test was conducted by forming a film of cobalt (Co) alloy through welding and manufacturing the test pieces as shown in FIG. 8-1.

It is understood from the characteristic diagram of FIG. 8-2 that when the film formed through the electrical-discharge surface treatment using the electrode for electrical-discharge surface treatment according to the present embodiment is used, the wear loss is low in a range from the low temperature range (about 300° C. or less) to the high temperature range (about 700° C. or higher), which shows superior wear resistance. More specifically, it is clear that the wear loss is low in all the temperature ranges of the low temperature range (about 300° C. or less), the intermediate temperature range (from about 300° C. to about 700° C.), and the high temperature range (about 700° C. or higher), which shows excellent wear resistance.

It is noted that because the sliding test is performed by simulating an operation environment of a gas turbine engine for aircraft, tests at all the temperatures are carried out by setting a predetermined temperature after the temperature is previously increased to a temperature of 650° C.

As explained above, according to the electrode for electrical-discharge surface treatment in the present embodiment, it is possible to obtain the electrode for electrical-discharge surface treatment capable of forming the film excellent in wear resistance in the temperature range from the low temperature to the high temperature through the electrical-discharge surface treatment by pulverizing and oxidizing the metal powder so that the amount of oxygen contained therein is in a range from 4 weight % to 16 weight %, by mixing the oxidized metal powder with the organic binder and the solvent to prepare the liquid mixture, using the liquid mixture to prepare the granulated powder through granulation, and further by forming the granulated powder to prepare the compact.

Second Embodiment

In the first embodiment, the case where paraffin is used as wax (organic binder) to be added to the pulverized powder is explained, but in the present invention, an acrylic resin can also be used as the organic binder to be added to the pulverized powder. In a second embodiment, a case where an acrylic resin is used as the organic binder to be added to the pulverized powder is explained below.

Commercially available cobalt (Co) alloy powder with an average particle size of 10 μm, which is mixed in the ratio of "28 weight % molybdenum (Mo), 17 weight % chromium (Cr), 3 weight % silicon (Si), and the rest cobalt (Co)", was powdered to obtain powder with an average particle size of about 1.5 μm by an atomization method and classification. Thereafter, the powder was heated as explained in the first embodiment.

Acrylic wax as the wax (organic binder) was mixed in the powder at a weight ratio of 8 weight % thereto to prepare a liquid mixture. BR resin manufactured by Mitsubishi Rayon Co. Ltd. was used for the acrylic wax, acetone was used for the solvent, and a solute concentration with respect to the acetone was set to 15 volume %.

Thereafter, the BR resin, the acetone, and the pulverized powder were concurrently mixed by a mixer. As is explained in the first embodiment, the solution was supplied by the spray dryer under conditions such that revolutions of an atomizer were set to 10000 rpm and a supply amount of the solution was 2 kg per hour. Nitrogen was dried under temperature conditions such that the inlet temperature was 100° C. and the outlet temperature was 70° C. As a result, the granulated powder with an average particle size of 20 μm to 30 μm was prepared.

Consequently, the granulated powder was compressed and formed into a shape with an electrode size: 50 mm×11 mm×5 mm under a press pressure of 50 MPa using the same method as that of the first embodiment, to prepare a compact. Thereafter, the compact was heated to manufacture the cobalt (Co) alloy electrode (electrode for electrical-discharge surface treatment).

The resistance on the electrode surface of the cobalt (Co) alloy electrode (electrode for electrical-discharge surface treatment) according to the present embodiment thus manufactured was measured by a surface resistivity meter using the four-terminal method in which an interelectrode distance is 2 mm. As a result of measurement, the resistance was $6.0\times10^{-}$ $_3\Omega$ to $13\times10^{-3}\Omega$. Furthermore, the amount of oxygen contained in the cobalt (Co) alloy electrode (electrode for electrical-discharge surface treatment) was measured by the infrared absorption method. As a result of measurement, the oxygen concentration was 6 weight %.

Even by the method according to the present embodiment, it is possible to obtain the electrode for electrical-discharge surface treatment with less variations of resistivity, similarly to the first embodiment. The film formed through the electrical-discharge surface treatment using the electrode for electrical-discharge surface treatment prepared by the method according to the present embodiment also shows excellent wear resistance over the wide range of temperature, similarly to the first embodiment.

Therefore, according to the electrode for electrical-discharge surface treatment in the present embodiment, it is possible to obtain the electrode for electrical-discharge surface treatment capable of forming the film excellent in wear resistance in the temperature range from the low temperature to the high temperature through the electrical-discharge surface treatment.

Third Embodiment

In the second embodiment, the case where the acrylic resin is used as the wax (organic binder) to be added to the pulverized powder and the acetone is used to dissolve the wax is explained. In a third embodiment, however, a case where water-soluble PVA (polyvinyl alcohol) is used as the organic binder added to the pulverized powder is explained below.

Cobalt (Co) alloy powder, which was mixed in the ratio of "20 weight % chromium (Cr), 10 weight % nickel (Ni), 15 weight % tungsten (W), and the rest cobalt (Co)", was powdered to obtain powder with an average particle size of about 1 μm by an atomization method and classification, and 5 weight % of commercially available tungsten carbide (WC) with a particle size of 1 μm was added to the powder and mixed.

A mixture in which PVA was added to the water was mixed by a rotary mixer to melt the PVA therein, the pulverized powder was added to the mixture, and the mixture was further fully mixed by the rotary mixer to prepare a liquid mixture. The solute concentration with respect to the water was set to 10 volume %.

If the PVA is used as the organic binder, even if ethanol, propanol, or butanol is used, it can be dissolved in the same manner as the above case. In this case, the granulation needs to be performed in inert gas.

Next, the liquid mixture was dried and granulated by the spray dryer in the same manner as that of the second embodiment. At this time, drying and granulation may be performed in the inert gas, but because water is used, the liquid mixture can be granulated in the air. In the present embodiment, the solution was supplied in the air under conditions such that revolutions of an atomizer were set to 5000 rpm and a supply amount of the solution was 2 kg per hour. Nitrogen was dried under temperature conditions such that the inlet temperature was 140° C. and the outlet temperature was 110° C. This resulted in manufacture of the granulated powder with an average particle size of 80 μm. The powder was formed and heated to prepare an electrode in the same manner as that of the previously mentioned embodiments.

The resistance on the electrode surface of the cobalt (Co) alloy electrode (electrode for electrical-discharge surface treatment) according to the present embodiment thus manufactured was measured by a surface resistivity meter using the four-terminal method in which an interelectrode distance is 2 mm. As a result of measurement, the resistance was $8.0\times10^{-}$ $_3\Omega$. Furthermore, the amount of oxygen contained in the cobalt (Co) alloy electrode (electrode for electrical-discharge surface treatment) was measured by the infrared absorption method, and as a result of measurement, the oxygen concentration was 9 weight %.

Even by the method according to the present embodiment, it is possible to obtain the electrode for electrical-discharge surface treatment with less variations of resistivity, similarly to the first embodiment and the second embodiment. The film formed through the electrical-discharge surface treatment using the electrode for electrical-discharge surface treatment prepared by the method according to the present embodiment also shows excellent wear resistance over the wide range of temperature, similarly to the first embodiment and the second embodiment.

Therefore, according to the electrode for electrical-discharge surface treatment in the present embodiment, it is possible to obtain the electrode for electrical-discharge surface treatment capable of forming the film excellent in wear resistance in the temperature range from the low temperature to the high temperature through the electrical-discharge surface treatment.

In the embodiments, as the powder of the material for the electrode for electrical-discharge surface treatment, the powder with an average particle size of about 10 μm to 20 μm prepared by the water atomization method was used. However, the effect of the present invention is not limited only to the case where the powder prepared by the water atomization method is used. Moreover, the effect of the present invention is not limited only to the case where the average particle size ranges from 10 μm to 20 μm.

In the embodiments, the cobalt (Co) base alloy powder was used. The cobalt (Co) base alloy powder was prepared by melting metal, which was mixed in the ratio of "28 weight % molybdenum (Mo), 17 weight % chromium (Cr), 3 weight % silicon (Si), and the rest cobalt (Co)" or of "20 weight % chromium (Cr), 10 weight % nickel (Ni), 15 weight % tungsten (W), and the rest cobalt (Co)". However, if any metal contains a component that provides lubricity by being oxidized, it is not limited to the cobalt (Co) base. Furthermore, it is not necessarily an alloy. However, there are some cases where even if a material of which an oxide has lubricity is used, the lubricity cannot be provided as is chromium (Cr) depending on a combination of materials. Therefore, it is not preferable to use alloy metal with such a combination as above.

For example, if chromium (Cr) is mixed with another metal to prepare an alloy containing a large amount of nickel (Ni), a nickel (Ni)-chromium (Cr) intermetallic compound is formed, and this compound prevents oxidation of chromium (Cr), and thus, this material becomes difficult to provide lubricity. If powders of respective elements, but not an alloy, are used, uneven distribution of the materials in an electrode or a film may cause the electrode or the film to be inhomogeneous. Therefore, the mixing should carefully be performed.

In the embodiments, the cobalt (Co) base alloy powder was used. The cobalt (Co) base alloy powder was prepared by melting metal, which was mixed in the ratio of "28 weight % molybdenum (Mo), 17 weight % chromium (Cr), 3 weight % silicon (Si), and the rest cobalt (Co)" or of "20 weight % chromium (Cr), 10 weight % nickel (Ni), 15 weight % tungsten (W), and the rest cobalt (Co)". However, in addition to the mixture, even when any material containing oxides such as silicon (Si), chromium (Cr), iron (Fe), cobalt (Co), nickel (Ni), zirconium (Zr), molybdenum (Mo), barium (Ba), rhenium (Re), and tungsten (W) is used, the same effect as above is obtained although there is a little difference depending on the oxides.

Fourth Embodiment

In the first to the third embodiments, the technology for manufacturing the electrode using the powder obtained by oxidizing metal powder and for forming the film is explained, but a method of mixing oxide powder from the beginning may be used. In a present embodiment, a technology for manufacturing an electrode for electrical-discharge surface treatment containing a predetermined amount of oxygen by mixing metal powder with oxide powder to form a film is explained below.

A fourth embodiment of the present invention is explained below using a case, as an example, where a material as follows is manufactured, the material corresponding to an oxidized material of "28 weight % Mo (molybdenum), 17 weight % Cr (chromium), 3 weight % Si (silicon), and the rest Co (cobalt)". However, the same effect can also be obtained even if any material other than the material, for example, the material explained in the other embodiments is used.

At first, molybdenum (Mo), silicon (Si), and cobalt (Co) are mixed in an approximate ratio of "molybdenum (Mo): silicon (Si):cobalt (Co)=28:3:55", and powder is prepared using the water atomization method and the classification as shown in the first embodiment. Powder of chromium oxide ($Cr_2O_3$) is mixed with the powder in the approximate ratio of "$Cr_2O_3$:metal powder=25:83". This ratio indicates that the ratio of the chromium (Cr), molybdenum (Mo), silicon (Si), and cobalt (Co) in all the mixed powder is set to "chromium (Cr):molybdenum (Mo):silicon (Si):cobalt (Co)=17:28:3:55". In the present embodiment, this powder is called "cobalt alloy powder".

The two kinds of powder are mixed for 10 hours to 20 hours using a ball mill, to obtain mixed powder containing oxygen homogeneously.

The forming step of an electrode is explained below. A homogeneous compact is formed by improving flowability of powder when a mold is filled with the powder for press forming using the mold, making faster propagation of the press pressure to the inside of the powder, and reducing friction between the wall of the mold and the powder. To obtain the homogeneous compact, petroleum wax (paraffin) as the organic binder was added to the pulverized powder at a weight ratio of 10% thereto. The weight ratio of the amount of the organic binder to the pulverized powder needs to be set to a range from 1 weight % to 20 weight %.

If an organic-binder content is 1 weight % or less, the organic binder does not function as a binder, and hence, the pressure upon being pressed does not evenly spread and the strength of the compact is low, which makes it extremely difficult to handle the compact. On the other hand, if the organic-binder content exceeds 20 weight %, the powder is adhered to the mold when being pressed, and the compact may be cracked because the powder is not removed from the mold. Therefore, the amount of organic binder needs to be set to the range from 1 weight % to 20 weight % with respect to the pulverized powder. If the amount falls within the range, it is possible to adjust the porosity of a targeted compact by controlling the mixing ratio between the powder and the organic binder.

As a solvent to homogeneously mix the paraffin with the pulverized powder, normal-hexane was used. The normal-hexane was mixed with paraffin of 10 weight % of powder weight to dissolve the paraffin, and then, the cobalt alloy powder was added thereto and further mixed.

At this time, the amount of the normal-hexane was controlled so that the weight (weight of solute) of the cobalt alloy powder and the organic binder would become 10 volume % of the normal-hexane being the solvent. If the solute concentration with respect to the solvent is low, drying becomes difficult, and thus, granulated powder cannot be prepared. On the other hand, if the solute concentration is too high, the powder precipitates, and thus, the concentration of the solution becomes inhomogeneous. This makes it difficult to obtain homogeneous granulated powder. Therefore, it is necessary to control so that a solute component with respect to the solvent becomes 2 volume % to 30 volume %. By setting the total volume of the cobalt alloy powder and the organic binder to the range, homogeneous granulated powder can be obtained.

In the present embodiment, the wax was mixed in the solvent at the beginning and then the powder was fed into the mixed solvent, but the cobalt alloy powder may be fed thereinto from the beginning to be mixed.

The example of using the paraffin as the organic binder is explained above, but the organic binder may be isobutyl methacrylate, stearic acid, or polyvinyl alcohol other than the paraffin.

Furthermore, even if heptane or isobutane is used other than the normal-hexane as the solvent when the paraffin is used, the paraffin can be also dissolved. If any other solvent is used, the paraffin cannot sufficiently be dissolved. Therefore, by dispersing the paraffin in the state of powder, the granulated powder can also be obtained. Other solvents include water, ethanol, butanol, propanol, and acetone.

Next, as a granulating step, a dry granulator generally called a spray dryer was used to spray the mixed solution to an atmosphere in which high-temperature nitrogen was circulated, and the solvent was dried. At the time of drying, a solvent component (normal-hexane in the present embodiment) is volatile from the mixed solution, and the mixed solution becomes spherical granulated powder in which the oxidized metal powder and the organic binder are uniformly dispersed. The granulated powder has high flowability because of a small angle of repose, and the void spaces are evenly formed in a compact when being formed and shaped, which enables to obtain the compact with no variation in the density and the resistance.

To obtain an electrode having uniform density and resistance which is the object of the present invention, the average particle size of the granulated powder is preferably 10 μm to 100 μm. If the average particle size of the granulated powder is 10 μm or less, the flowability of the powder becomes low, and it is difficult to evenly fill the mold with the powder. On the other hand, if the average particle size of the granulated powder is 100 μm or more, the void spaces remaining upon press-forming of the power are easily enlarged, and a homogeneous electrode cannot thereby be obtained.

The example of using the spray dryer for granulation is explained in the present embodiment, but it is possible to obtain the granulated powder using any other method such as a fluidized granulator and a tumbling granulator.

Figure 9:
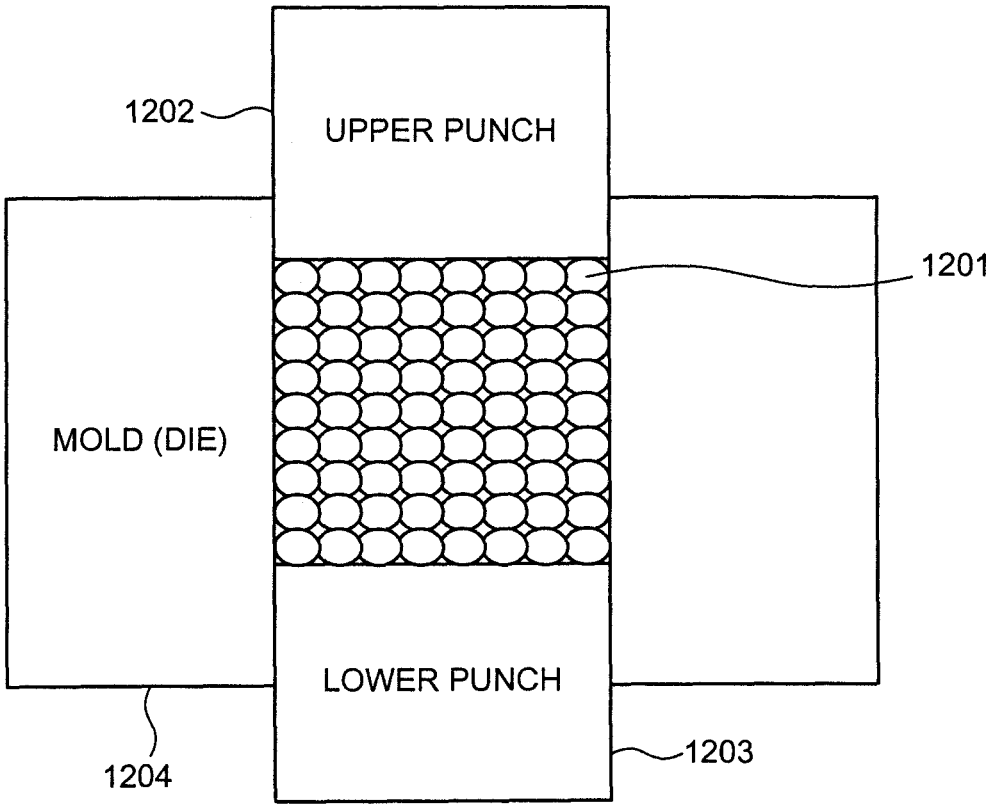
FIG. 9 is a cross-section for explaining a concept of a powder formation according to a fourth embodiment of the present invention.

The forming step of granulated powder is explained below with reference to FIG. 9. FIG. 9 is a cross-section representing a concept of the forming step of granulated powder according to the present embodiment. In FIG. 9, the space, which is surrounded with an upper punch 1202 of a mold, a lower punch 1203 of the mold, and a die 1204 of the mold, is filled with granulated powder 1201 prepared at the previous step. And, the granulated powder 1201 is compressed and formed to form a green compact (compact). In electrical-discharge surface treatment explained later, the green compact (compact) is used as a discharge electrode.

The press pressure and the sintering temperature for forming granulated powder are set to a range from 50 MPa to 200 MPa and a range of a heating temperature from 600° C. to 1000° C. although they are different depending on the resistance and the oxygen concentration of a targeted electrode. In the present embodiment, granulated powder was formed under a pressure of 100 MPa, to obtain the formed powder with a length of 100 mm, a width of 11 mm, and a thickness of 5 mm. It is noted that vibration was applied to the mold before forming so that the mold was uniformly filled with the powder, and the powder was pressurized and formed. If the forming pressure is lower than 50 MPa, the void spaces remain between the granulated powders, which does not enable to form a homogeneous electrode. If the forming pressure exceeds 200 MPa, cracking occurs in the electrode or the electrode cannot be removed from the mold. Therefore, the forming pressure is preferably 50 MPa to 200 MPa.

The obtained green compact (compact) is subjected to sintering. As a step of removing the organic binder from the electrode upon heating, the green compact is held for about 30 minutes to 2 hours at a temperature from 150° C. to 400° C. to enable stably and sufficiently remove the organic binder from a sintered compact. Generally, the organic binder has a property of expansion due to heating. Therefore, if the organic binder is rapidly heated, any defect in quality may easily occur such as expansion of or cracking in the electrode. As a result, the heating should not be increased to a sintering temperature at one time, and the compact needs to be temporarily held until the organic binder is completely removed therefrom.

In the present embodiment, the green compact (compact) was held in a vacuum furnace for 30 minutes at a temperature of 200° C., and was then heated up to 300° C. for 1 hour. The green compact was further heated up to 700° C. for 1 hour, held for about 1 hour, and cooled to room temperature to manufacture a cobalt (Co) alloy electrode made of the cobalt (Co) alloy powder.

The resistance of the electrode on its face with a length of 100 mm and a width of 11 mm corresponding to a pressed face of the cobalt (Co) alloy electrode was measured by a surface resistivity meter using the four-terminal method in which an interelectrode distance is 2 mm. As a result of measurement, the resistance was $7.5\times10^{-3}\Omega$.

The electrode is broken by pulsed discharge energy and is molten to be formed as a film, as shown in the latter part, and thus, it is important how easily the electrode is broken by electrical discharge. In such an electrode, the range from $5\times10^{-3}\Omega$ to $10\times10^{-3}\Omega$ is an appropriate value of the resistance on the surface of the electrode measured using the four-terminal method, and the range from $6\times10^{-3}\Omega$ to $9\times10^{-3}\Omega$ is more preferable.

Figures 1, 10:
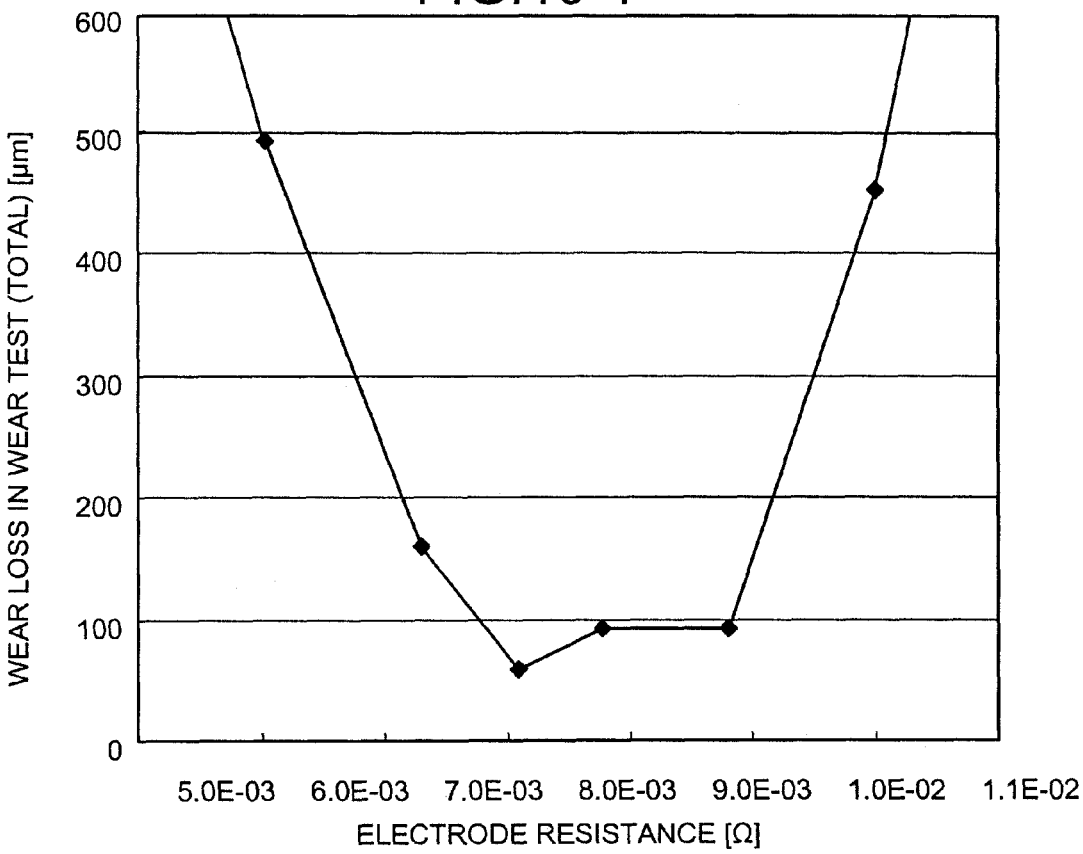
Figures 2, 10:
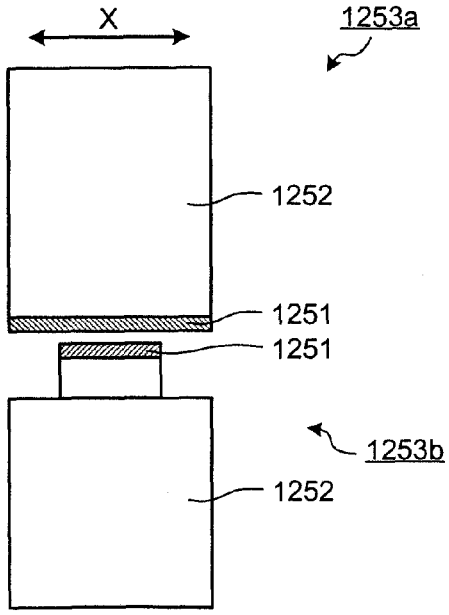

A plurality of electrodes with different resistances on the surfaces of the electrodes thus manufactured were used to form films using the electrical-discharge surface treatment method explained later, and the sliding test was conducted. The result of the sliding test is shown in FIG. 10-1. In FIG. 10-1, the horizontal axis represents the resistance in ohm (Ω) of the electrode surface. The vertical axis represents the wear loss of the electrode. As a test piece, test pieces (upper test piece 1253*a* and lower test piece 1253*b*) were made by welding films 1251 onto respective test-piece bodies 1252 using TIG welding as shown in FIG. 10-2.

The upper test piece 1253*a* and the lower test piece 1253*b* were arranged so that the films 1251 face each other. And a test was conducted by sliding the test pieces in a reciprocating manner in the X direction of FIG. 10-2 by $1\times10^{6}$ cycles at a frequency of 40 Hz with a width of 0.5 mm while a load was applied so that their surface pressure becomes 7 MPa. It is noted that the film was welded onto the test-piece body 1252 and then the film was ground to smooth the surface of the film 1251.

As is clear from FIG. 10-1, when the electrode with the range of the resistance on the electrode surface from $5\times10^{-3}\Omega$ to $10\times10^{-3}\Omega$ is used, the wear loss is low, and when the electrode with the range from $6\times10^{-3}\Omega$ to $9\times10^{-3}\Omega$ is used, the wear loss is particularly low. Therefore, as the electrode used in the present embodiment, the range from $5\times10^{-3}\Omega$ to $1\times10^{-3}\Omega$ is an appropriate value as the resistance on the electrode surface using the four-terminal method, and the range from $6\times10^{-3}\Omega$ to $9\times10^{-3}\Omega$ is more preferable.

Figure 14:
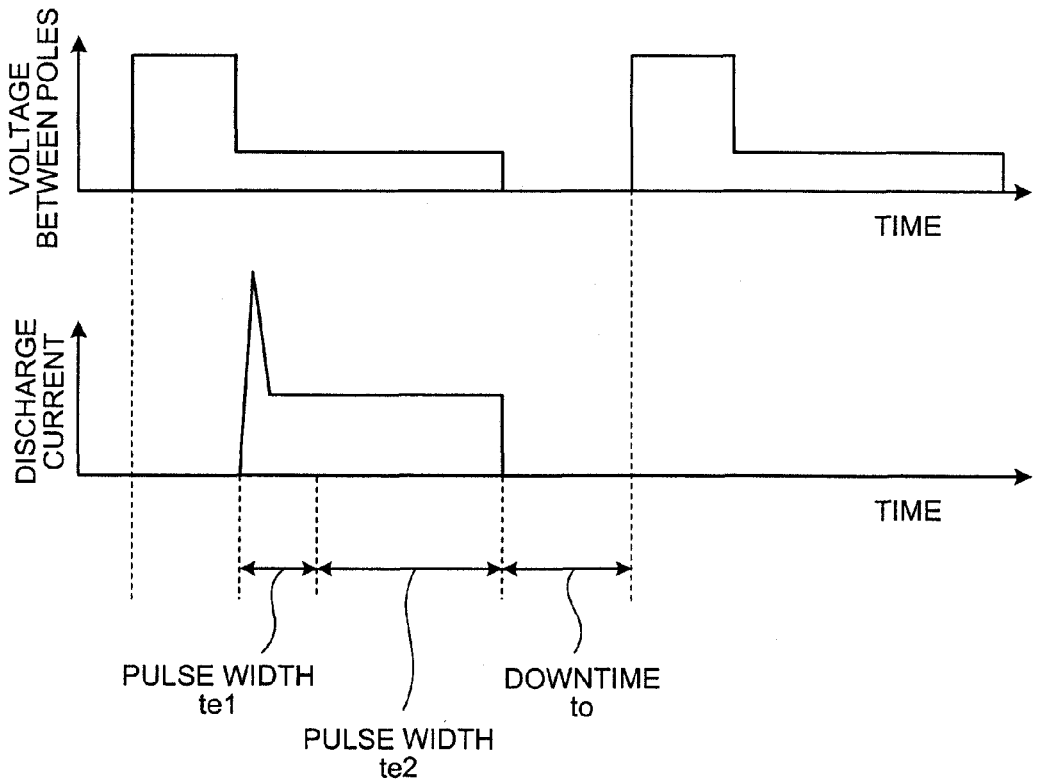
FIG. 14 is a diagram representing another example of the pulse conditions for electrical discharge during electrical-discharge surface treatment.

Electrical conditions for the electrical-discharge surface treatment used for the sliding test are such that a waveform is applied with a current with a narrow width and a high peak during a period of discharge pulses, as shown in FIG. 14 explained later, a current value at the portion of the high peak is about 15 A, a current value at the portion of a low peak is about 4 A, and that discharging duration (discharge pulse width) is about 10 μs.

Figure 11:
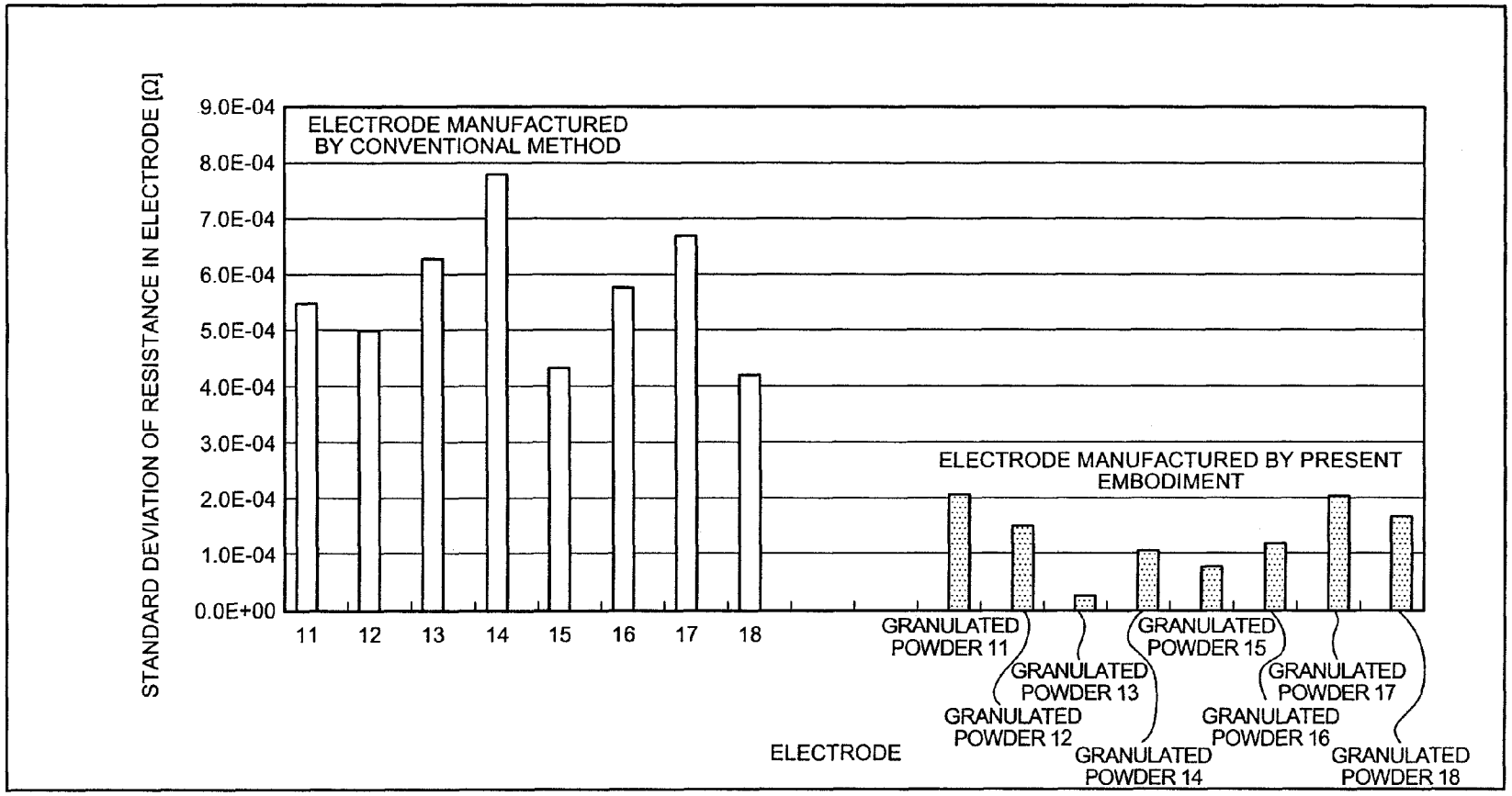
FIG. 11 is a chart representing standard deviation of resistance on an electrode surface of the electrode according to the fourth embodiment of the present invention.

FIG. 11 represents the standard deviation of resistances measured on the electrode at three points such as both ends and a center thereof in its longitudinal direction using the four-terminal method. In FIG. 11, the horizontal axis represents electrodes, and the vertical axis represents the standard deviation of the resistances measured at the three points. The resistances of the electrode press-formed and manufactured in the conventional method are also shown FIG. 11 for reference. The electrode was manufactured as follows: shape of electrode: 100 mm length×11 mm width×5 mm thickness, press pressure: 100 MPa, and sintering in vacuum: 700° C.×1 hour. It is obvious from the chart that there are sufficiently small variations in the resistance at each position in the longitudinal direction of the electrode made by using the powder according to the present invention.

The amount of oxygen of the electrode manufactured in the present embodiment was measured by the infrared absorption method, and as a result of measurement, the oxygen concentration was 10 weight %. The oxygen concentration of the electrode is not always equal to that of the powder used. To exhibit excellent wear resistance over a wide range of temperature, the amount of oxygen of the film becomes eventually important, and the film most excellent in the wear resistance can be obtained when the amount of oxygen of the film ranges from 5 weight % to 9 weight %.

The resistance and the oxygen concentration of the electrode are determined by an oxygen concentration of the powder to be used, and by the amount of binder, a press pressure, and a sintering temperature upon manufacture of the electrode. Therefore, it is important to manufacture the electrode by adequately controlling these requirements so that the resistance and the amount of oxygen of the electrode fall within the appropriate ranges.

Figure 12:
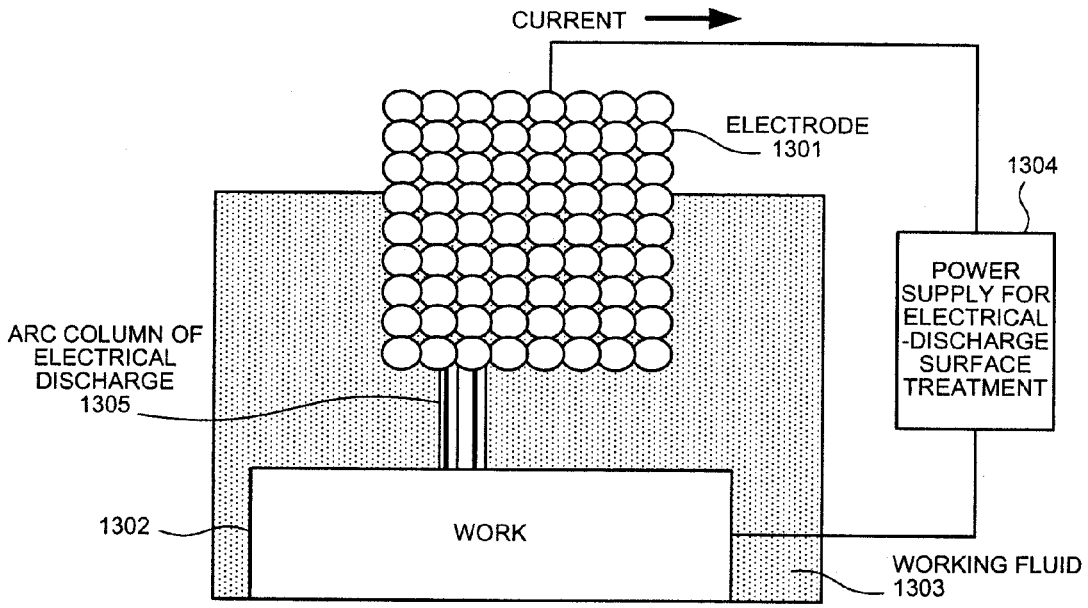
FIG. 12 is a schematic diagram of a configuration of an electrical-discharge surface treatment device that performs electrical-discharge surface treatment according to the fourth embodiment of the present invention.

Next, a film is formed on a material to be treated (work) by the electrical-discharge surface treatment method using the electrode manufactured in the above manner. FIG. 12 represents a schematic diagram of a configuration of an electrical-discharge surface treatment device that performs electrical-discharge surface treatment in the present embodiment. As shown in FIG. 12, the electrical-discharge surface treatment device according to the present embodiment includes an electrode 1301 made of the granulated powder of the cobalt alloy powder, oil as working fluid 1303, a working fluid supply unit (not shown) that immerses the electrode 1301 and a work 1302 in the working fluid or supplies the working fluid 1303 between the electrode 1301 and the work 1302, and a power supply 1304 for electrical-discharge surface treatment that applies a voltage between the electrode 1301 and the work 1302 to generate pulsed discharge (arc column 1305). In FIG. 12, some components not directly related to the present invention, such as a drive unit that controls a relative position between the power supply 1304 for electrical-discharge surface treatment and the work 1302, are omitted.

To form the film on the work surface by the electrical-discharge surface treatment device, the electrode 1301 and the work 1302 are arranged so as to face each other in the working fluid 1303, and pulsed discharge is generated from the power supply 1304 for electrical-discharge surface treatment between the electrode 1301 and the work 1302 in the working fluid 1303. The film of the electrode material is formed on the work surface by discharge energy of the pulsed discharge, or the film of a substance with which the electrode material reacts is formed on the work surface by the discharge energy. A negative polarity is used for the electrode 1301 and a positive polarity is used for the work 1302. As shown in FIG. 12, the arc column 1305 of the electrical discharge is generated between the electrode 1301 and the work 1302.

Figures 1, 13:
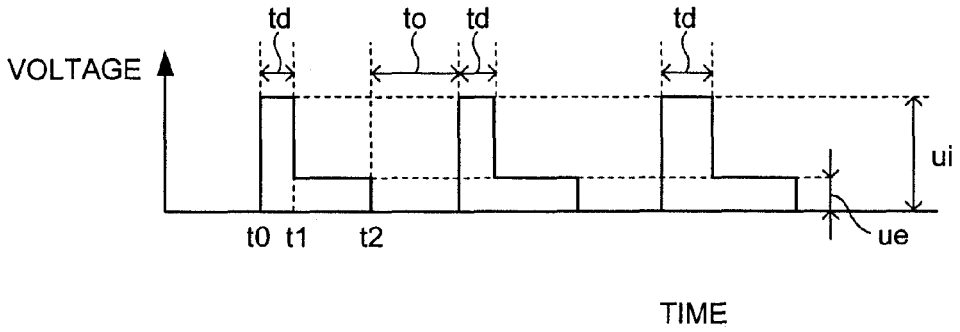
Figures 2, 13:
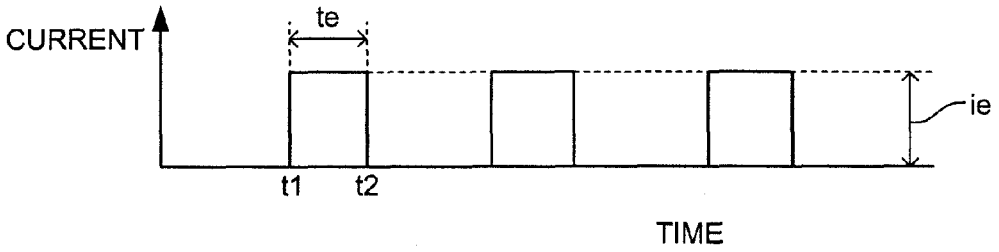

The electrical-discharge surface treatment was performed by using the green compact electrode manufactured under the conditions to form the film. One example of pulse conditions for electrical discharge during electrical-discharge surface treatment are shown in FIG. 13-1 and FIG. 13-2. FIG. 13-1 and FIG. 13-2 are diagrams representing one example of pulse conditions for electrical discharge during electrical-discharge surface treatment. FIG. 13-1 represents a voltage waveform between an electrode and a work upon electrical discharge, and FIG. 13-2 represents a current waveform of a current flowing upon electrical discharge. In FIG. 13-1, the voltage of the electrode with the negative polarity is described on the horizontal axis (positive).

As shown in FIG. 13-1, a non-load voltage ui is applied between both poles at time t0, but a current starts flowing between the both poles at time t1 after passage of discharge delay time td, and electrical discharge starts. The voltage at this time is a discharge voltage ue and the current flowing at this time is a peak current value ie. If supply of the voltage between the both poles is stopped at time t2, the current does not flow.

Time t2 to t1 is a pulse width te. The voltage waveform during time t0 to t2 is repeatedly applied to the both poles after downtime "to". In other words, as shown in FIG. 13-1, a pulsing voltage is applied between the electrode for electrical-discharge surface treatment and the work.

In the present embodiment, when the current waveform is a rectangular waveform as shown in FIG. 13-2, appropriate electrical conditions for discharge pulse during electrical-discharge surface treatment are such that a peak current value ie=2 A to 10 A and discharging duration (discharge pulse width) te=5 μs to 20 μs. However, these ranges may slightly shift depending on how easily the electrode is broken. Moreover, to break the electrode more satisfactorily by pulses of electrical discharge, it has become understood that a waveform applied with a current whose width is narrow and peak is high during a period of discharge pulse is effective as shown in FIG. 14. In FIG. 14, the voltage of the electrode with the negative polarity is described on the horizontal axis (positive).

By using such a current waveform, the electrode can be broken by the current having the waveform with the high peak as shown in FIG. 14, and melting can be progressed by the current having the waveform with the low peak and the wide width as shown in FIG. 14, which enables the film to be formed on the work 1302 at a high speed. In this case, the appropriate current value at the portion of the waveform with the high peak was about 10 A to 30 A, the appropriate current value at the portion of the waveform with the low peak and the wide width was about 2 A to 6 A, and the appropriate discharging duration (discharge pulse width) was about 4 μs to 20 μs. If the current at the portion of the waveform with the low peak and the wide width is lower than 2 A, it becomes difficult to continue the discharge pulse, and this leads to an increase in phenomenon of pulse crack which means the current is disconnected in midstream.

Fifth Embodiment

A method of oxidizing the powder at the step of pulverizing the powder, but not a method of oxidizing the powder by heating or of mixing an oxide with the powder, is explained below.

Figure 15:
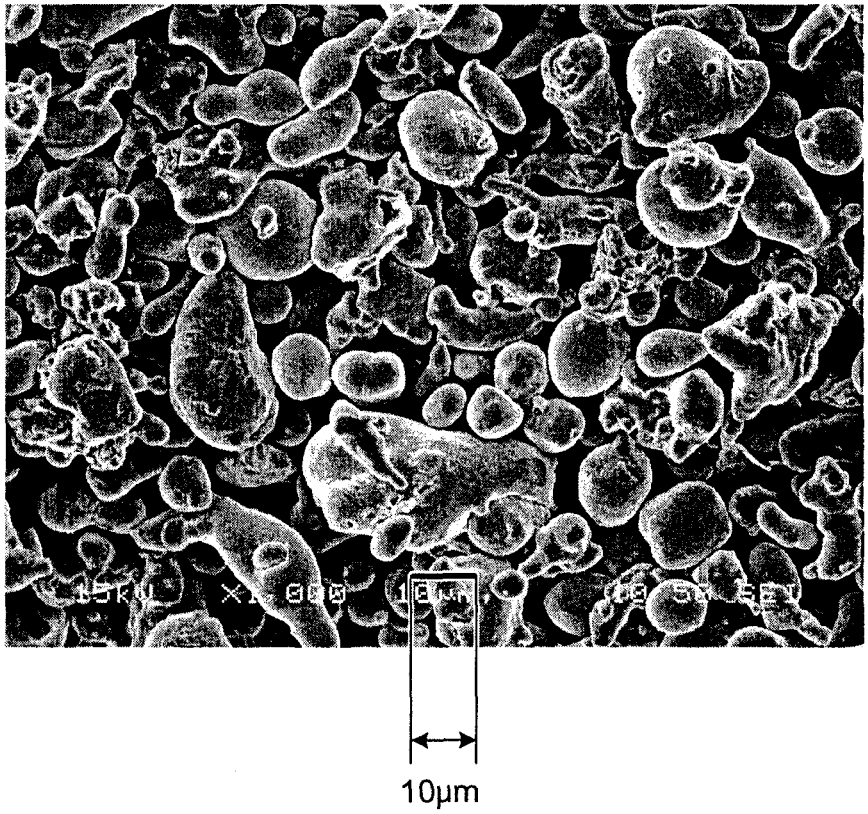
FIG. 15 is an SEM image of a state of cobalt (Co) alloy powder which is raw powder material.

At first, a raw powder material was prepared in a present embodiment. As the raw powder material, cobalt (Co) alloy powder with an average particle size of 20 μm, in which composition was "25 weight % chromium (Cr), 10 weight % nickel (Ni), 7 weight % tungsten (W), and the rest cobalt (Co)", was purchased. The cobalt (Co) alloy powder was prepared by melting metal mixed in the ratio of "25 weight % chromium (Cr), 10 weight % nickel (Ni), 7weight % tungsten (W), and the rest cobalt (Co)" using the water atomization method. An image representing a state of the cobalt (Co) alloy powder which is the raw powder material is shown in FIG. 15. The image shown in FIG. 15 is a Scanning Electron Microscope (SEM) photograph. There is almost no oxygen in the powder in this state and the amount of oxygen is 1% or less even at maximum.

In the present embodiment, the powder with the average particle size of 20 μm was used, but the size of the powder to be used in the present invention is not limited thereto. In other words, even powder with the average particle size larger than 20 μm and even powder with the average particle size smaller than 20 μm can be used. However, when the powder with the average particle size larger than 20 μm is used, longer time is required for pulverizing the powder as explained below. Further, when the powder with the average particle size smaller than 20 μm is used, the amount of powder to be collected through classification becomes smaller, which causes an increase in cost. These are only differences between the two cases.

Figure 16:
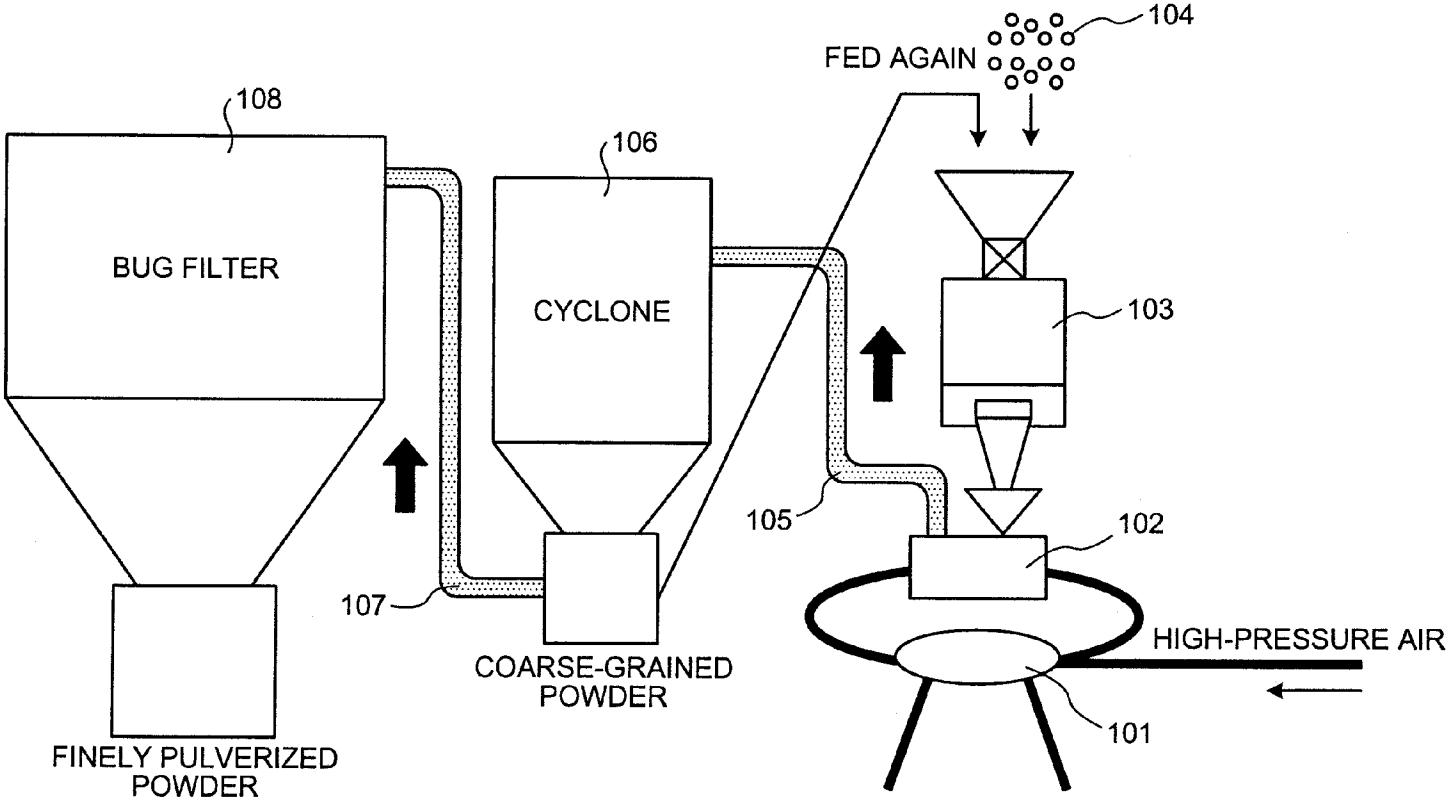
FIG. 16 is a schematic diagram of one example of a configuration of a spiral jet mill.
Figure 17:
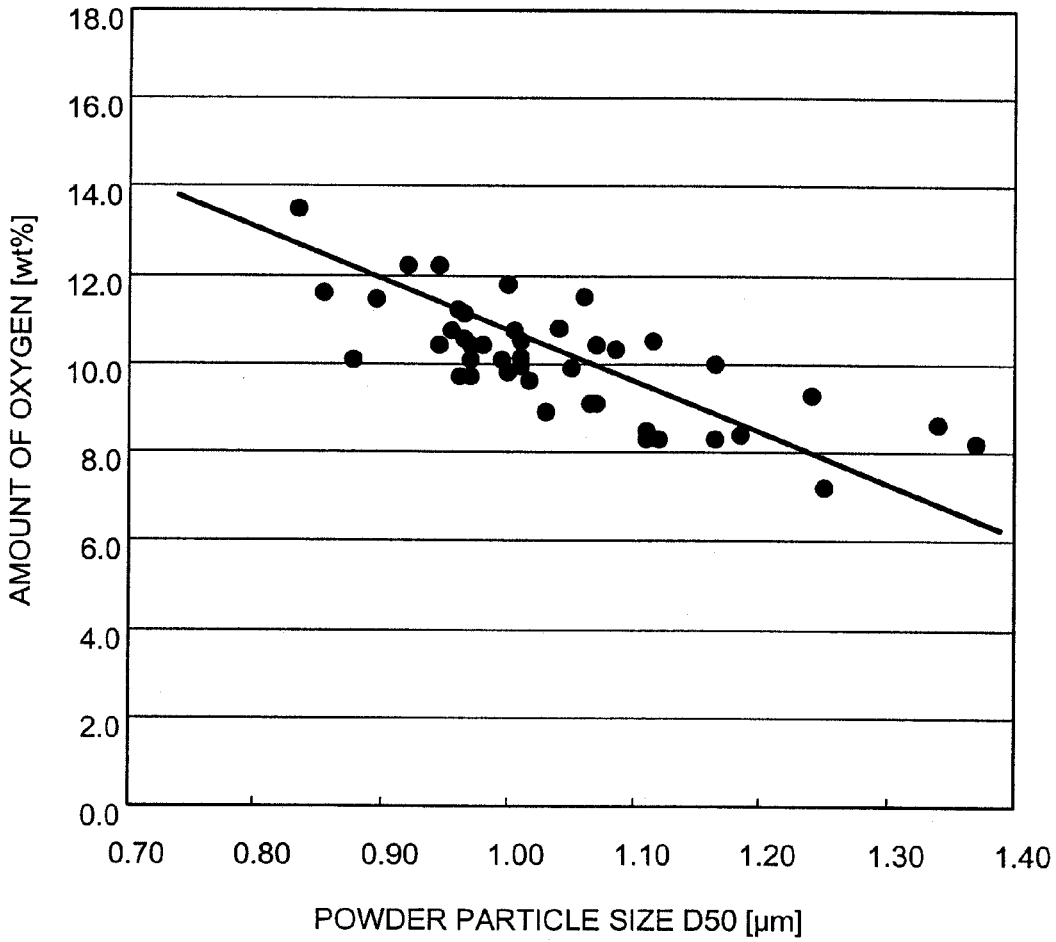
FIG. 17 is a characteristic diagram representing a relationship between a particle size of powder and a concentration of oxygen contained in the powder according to a fifth embodiment of the present invention.
Figure 18:
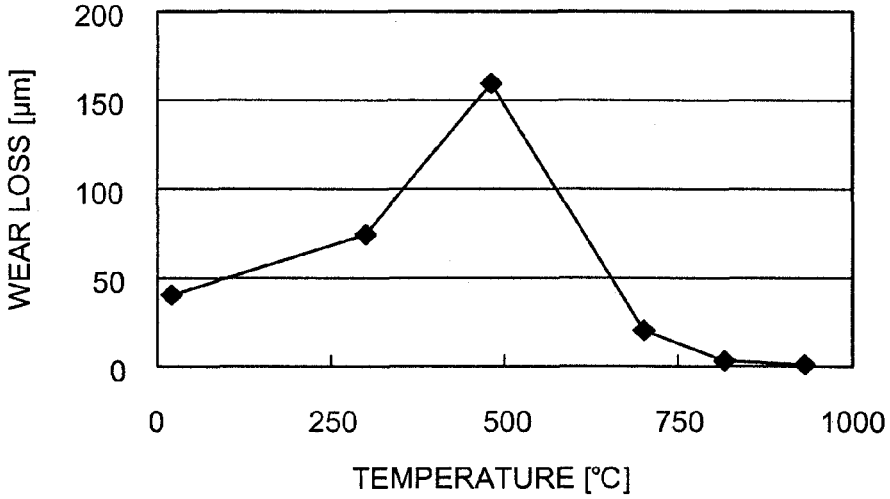
FIG. 18 is a characteristic diagram representing a relationship between temperature and wear loss of test pieces when a sliding test was conducted with a conventional wear-resistant material.
Figure 19:
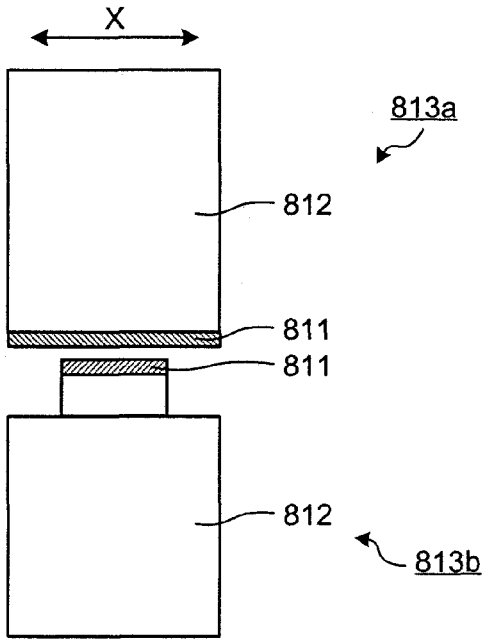
FIG. 19 is a schematic representing test pieces obtained by welding the conventional wear-resistant material onto respective test-piece bodies using TIG welding.

A step of oxidizing the powder is explained below. In the present embodiment, as the step of oxidizing the powder, the powder was pulverized by a jet mill in the air i.e. in the oxidizing atmosphere. FIG. 16 is a schematic diagram representing one example of a configuration of a spiral jet mill. In the spiral jet mill, high-pressure air is supplied from an air compressor (not shown) through a buffer tank 101 to form a high-speed spiral flow in a grinding chamber 102 of the jet mill. A raw powder material 104 is fed from a feeder 103 to the grinding chamber 102 and the powder is pulverized by the energy of the high-speed spiral flow. The spiral jet mill is described, for example, in Japanese Patent Application Laid-Open No. 2000-42441, and thus, details thereof are omitted.

Generally, the pressure of the air is set to about 0.5 MPa and used in the spiral jet mill, but when the cobalt (Co) alloy powder mixed in the ratio of "25 weight % chromium (Cr), 10 weight % nickel (Ni), 7 weight % tungsten (W), and the rest cobalt (Co)" is used in the present embodiment, it cannot be pulverized under the normal pressure. Therefore, it is necessary to increase the pressure from about 1.0 MPa to 1.6 MPa. Coarse-grained powder 105 pulverized in and discharged from the jet mill is classified in a cyclone 106, and finely pulverized powder 107 is caught by a bug filter 108. Insufficiently pulverized powder is collected by the cyclone 106, and is again fed into the jet mill, where the pulverization is continued, and the powder can thereby be finely pulverized. The pulverization is not necessarily performed only by the jet mill, and thus, other methods such as a bead mill, a vibration mill, and a ball mill may be used, but these methods take long time for pulverization to cause efficiency to be reduced.

In the spiral jet mill, the particle size of the pulverized powder is determined according to the pressure of compressed air and the number of times of pulverization. The inventors have found from their experiments that there is an extremely strong correlation between the amount of oxygen contained in the pulverized powder and the particle of pulverizing, by the spiral jet mill, the cobalt (Co) alloy powder with the average particle size of about 10 μm to 20 μm prepared using the water atomization method, but the method using the jet mill is not limited thereto. More specifically, other methods using the jet mill include an opposite jet mill that pulverizes powder by jetting the powder from opposite two directions to hit against each other, and an impacting method of pulverizing powder by impacting the powder against a wall surface. Any of the methods can be used if the same type of powder is obtained.

The step of pulverizing the powder by the jet mill has an important meaning such that the powder is uniformly oxidized in addition to finer pulverization of the alloy powder. Therefore, the pulverization needs to be performed in an oxidizing atmosphere such as an air atmosphere. When the metal powder is pulverized, attention is generally paid so as to prevent the metal powder from being oxidized as much as possible. For example, when the jet mill is used, the powder is prevented from being oxidized by using nitrogen as high pressure gas used for pulverization. When the ball mill or the vibration mill which is another pulverizing method is used, a solvent is mixed with the powder to be pulverized, and the pulverized powder is usually prevented from contacting oxygen as much as possible.

In the present invention, however, it is essential to oxidize the pulverized powder. The method of oxidizing the powder is not limited to the jet mill. Even if the ball mill or the vibration mill being another pulverizing method is used, the same effect as that of the jet mill can be obtained if the powder can be pulverized while being oxidized. However, in the ball mill or the vibration mill, a pot with the powder therein has to be of pulverizing, by the spiral jet mill, the cobalt (Co) alloy powder with the average particle size of about 10 μm to 20 μm prepared using the water atomization method, but the method using the jet mill is not limited thereto. More specifically, other methods using the jet mill include an opposite jet mill that pulverizes powder by jetting the powder from opposite two directions to hit against each other, and an impacting method of pulverizing powder by impacting the powder against a wall surface. Any of the methods can be used if the same type of powder is obtained.

The step of pulverizing the powder by the jet mill has an important meaning such that the powder is uniformly oxidized in addition to finer pulverization of the alloy powder. Therefore, the pulverization needs to be performed in an oxidizing atmosphere such as an air atmosphere. When the metal powder is pulverized, attention is generally paid so as to prevent the metal powder from being oxidized as much as possible. For example, when the jet mill is used, the powder is prevented from being oxidized by using nitrogen as high pressure gas used for pulverization. When the ball mill or the vibration mill which is another pulverizing method is used, a solvent is mixed with the powder to be pulverized, and the pulverized powder is usually prevented from contacting oxygen as much as possible.

In the present invention, however, it is essential to oxidize the pulverized powder. The method of oxidizing the powder is not limited to the jet mill. Even if the ball mill or the vibration mill being another pulverizing method is used, the same effect as that of the jet mill can be obtained if the powder can be pulverized while being oxidized. However, in the ball mill or the vibration mill, a pot with the powder therein has to be sealed, and this requires the setting of an environment under which oxidization is easily performed by periodically opening the pot. Therefore, this method has such a defect that it is difficult to control how the powder is oxidized and thus the variation in quality may easily occur.

As explained above, there are many cases where the solvent and the powder are usually mixed with each other and the mixture is pulverized in the ball mill or the vibration mill, but at the pulverizing step, almost no oxidization of the powder is progressed when the powder and the solvent are mixed. Therefore, the powder was pulverized without the solvent fed therein. As a result of this, it is found difficult to handle the powder due to such reasons as a container having heat and adhesion of the powder to balls.

When the solvent and the powder are mixed with each other and the mixture is pulverized, the oxidization of the powder advances at a rapid pace in a drying stage after pulverized. Consequently, it was necessary to select an appropriate condition while changing the oxygen concentration and the drying temperature in the atmosphere upon drying. As compared with the pulverization by the ball mill or the vibration mill, in the pulverization by the jet mill, the amount of oxygen i.e. the degree of oxidization of the pulverized powder is roughly determined by the particle size of the pulverized powder. Therefore, controlling of the particle size allows the control of the degree of the oxidization, which makes it comparatively easy to treat the powder.

INDUSTRIAL APPLICABILITY

As explained above, the method of manufacturing the electrode for electrical-discharge surface treatment according to the present invention is useful for manufacture of an electrode for electrical-discharge surface treatment used to form a film excellent in wear resistance in a temperature range from low temperature to high temperature.

The invention claimed is:

1. A method of manufacturing an electrode for electrical-discharge surface treatment used for electrical-discharge surface treatment for using a formed compact obtained by forming metal powder, metal compound powder, or conductive ceramics powder as an electrode, generating pulsed discharge between the electrode and a work in a working fluid or in the air, and forming a film on a surface of the work by energy of the pulsed discharge, the film being made of a material of the electrode or made of a substance with which the material of the electrode reacts, the method comprising:

increasing oxygen content in the powder;

mixing the powder, in which the oxygen content is increased, with an organic binder and a solvent to prepare a liquid mixture;

granulating the powder in the liquid mixture to form granulated powder; and forming the granulated powder to prepare a compact in which an oxygen concentration ranges from 4 weight % to 16 weight %.

2. The method according to claim 1, wherein the increasing includes treating the metal powder so that oxygen content in the powder ranges from 4 weight % to 16 weight %.

3. The method according to claim 2, wherein the increasing includes pulverizing the metal powder so that an average particle size of the metal powder ranges from 0.5 μm to 1.7 μm.

4. The method according to claim 2, wherein the increasing includes heating the metal powder in an oxidizing atmosphere.

5. The method according to claim 2, wherein the increasing includes mixing the metal powder with oxide powder.

6. The method according to claim 2, wherein the metal powder contains an oxide of at least one or more elements selected from a group including silicon (Si), chromium (Cr), iron (Fe), cobalt (Co), nickel (Ni), zirconium (Zr), molybdenum (Mo), barium (Ba), rhenium (Re), and tungsten (W).

7. The method according to claim 2, wherein the organic binder is at least one selected from a group including paraffin, isobutyl methacrylate, stearic acid, and polyvinyl alcohol.

8. The method according to claim 2, wherein an amount of the organic binder to be mixed is set to 1 weight % to 20 weight % with respect to a weight of oxidized metal powder.

9. The method according to claim 2, wherein the solvent is at least one selected from a group including water, ethanol, butanol, propanol, heptane, isobutane, acetone, and normal-hexane.

10. The method according to claim 2, wherein as the liquid mixture, a liquid mixture, in which a total volume of solute components of oxidized metal powder and the organic binder is set to 2 volume % to 30 volume % as a volume ratio with respect to the solvent, is prepared.

11. The method according to claim 2, wherein an average particle size of the granulated powder ranges from 10 μm to 100 μm.

12. The method according to claim 2, wherein the granulated powder is press-formed under a pressure of 50 MPa to 200 MPa to prepare a compact.

13. The method according to claim 12, further comprising holding the compact for 30 minutes to 2 hours at a temperature of 150° C. to 400° C. and sintering the compact for 1 hour to 4 hours at a temperature of 600° C. to 1000° C.

* * * * *